United States Patent [19]

Mitsudo et al.

[11] 4,109,633

[45] Aug. 29, 1978

[54] SPARK-PLUG FOR AUTOMOBILE INTERNAL COMBUSTION ENGINE

[75] Inventors: Hiroyuki Mitsudo, Kawanishi; Masazumi Yoshida, Amagasaki, both of Japan

[73] Assignee: New Cosmos Electric Company Limited, Osaka, Japan

[21] Appl. No.: 720,798

[22] Filed: Sep. 7, 1976

[30] Foreign Application Priority Data

| | | | |
|---|---|---|---|
| Sep. 16, 1975 | [JP] | Japan | 50-110873 |
| Sep. 16, 1975 | [JP] | Japan | 50-110874 |
| Oct. 2, 1975 | [JP] | Japan | 50-118270 |
| Oct. 17, 1975 | [JP] | Japan | 50-124267 |
| Oct. 31, 1975 | [JP] | Japan | 50-130484 |
| Nov. 17, 1975 | [JP] | Japan | 50-137279 |
| Dec. 3, 1975 | [JP] | Japan | 50-142908 |
| Dec. 3, 1975 | [JP] | Japan | 50-142909 |
| Dec. 3, 1975 | [JP] | Japan | 50-142910 |
| Dec. 3, 1975 | [JP] | Japan | 50-142911 |
| Feb. 9, 1976 | [JP] | Japan | 51-012249 |
| Feb. 14, 1976 | [JP] | Japan | 51-014407 |

[51] Int. Cl.[2] ..... F02P 1/00; H01T 13/20; H01T 13/28

[52] U.S. Cl. ..... 123/169 EL; 123/169 MG; 313/141; 313/118

[58] Field of Search ..... 123/169 MG, 169 P, 169 G, 123/169 R, 169 EL; 313/118, 141

[56] References Cited

U.S. PATENT DOCUMENTS

| | | | |
|---|---|---|---|
| 1,116,655 | 11/1914 | Whalton | 313/141 |
| 1,290,780 | 1/1919 | Radtke | 313/118 |
| 1,941,279 | 12/1933 | Sharpnack | 313/118 |
| 2,048,028 | 7/1936 | Rabezzana et al. | 313/118 |
| 2,080,495 | 5/1937 | McKone | 313/141 |
| 2,108,332 | 2/1938 | Guillon et al. | 123/169 EL |
| 2,208,178 | 7/1940 | Berstler | 313/141 |
| 2,650,583 | 9/1953 | Devaux | 313/141 |
| 3,323,911 | 6/1967 | Inoue | 313/118 |
| 3,603,835 | 9/1971 | Eaton | 313/118 |
| 3,866,074 | 2/1975 | Smith | 313/118 |
| 3,970,885 | 7/1976 | Kasima | 123/169 EL |
| 4,031,867 | 6/1977 | Tasuda et al. | 123/32 ST |

*Primary Examiner*—Charles J. Myhre
*Assistant Examiner*—P. S. Lall
*Attorney, Agent, or Firm*—Cushman, Darby & Cushman

[57] ABSTRACT

Improved spark-plugs for automobile internal combustion engines are made in a manner that thermal conductance (G) from flame nucleus to the electrodes is made as small as possible through decreasing of fluid resistance with respect to minute flame nucleus gas flow in the discharge, the fluid resistance being made small by making the discharge electrodes thin or making at least one of its discharge electrodes streamlined. The spark-plugs are capable of igniting and burning such lean gas mixture of 1.25 or more in excess air ratio (F).

$$\left(F = \frac{\text{air fuel ratio of mixture gas}}{\text{equivalent air fuel ratio for stoichiometric reaction of mixture gas}}\right)$$

37 Claims, 100 Drawing Figures

FIG.23(a).
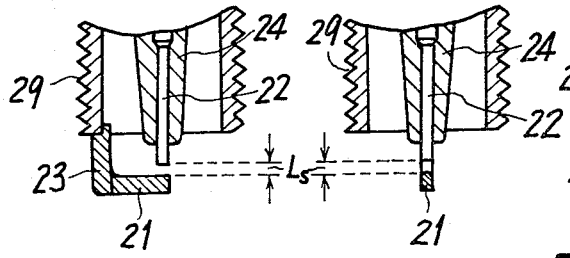
FIG.23(c).
FIG.24(a).
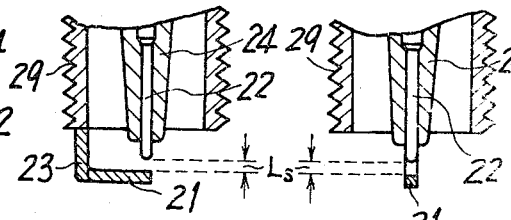
FIG.24(c).
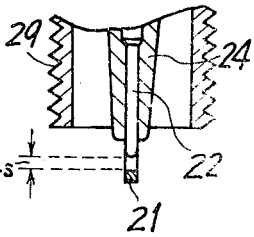
FIG.23(b).
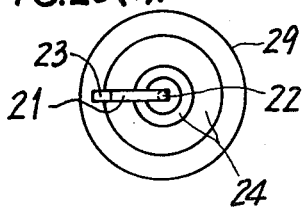
FIG.24(b).
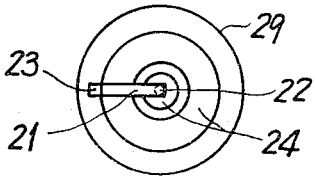
FIG.25(a).
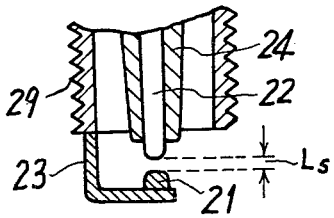
FIG.26(a).
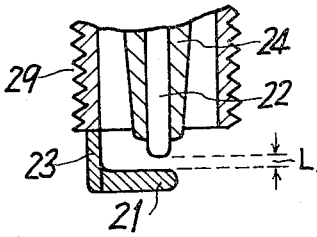
FIG.26(c).
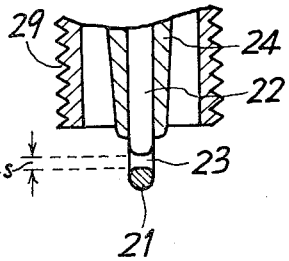
FIG.26(b).
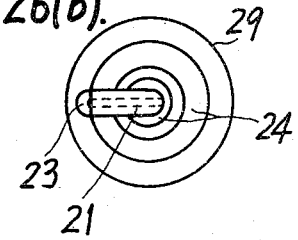
FIG.25(b).
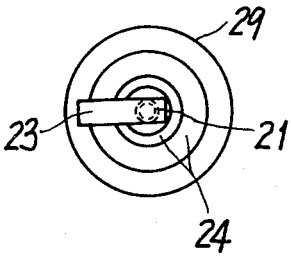
FIG.27(a).
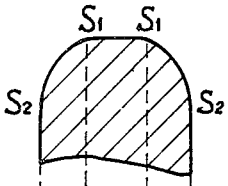
FIG.27(b).
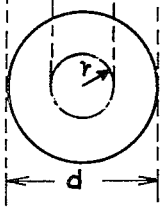

SPARK-PLUG FOR AUTOMOBILE INTERNAL COMBUSTION ENGINE

BACKGROUND OF THE INVENTION

This invention relates to an automobile internal combustion engines and particularly, to electric spark-plugs for the automobile internal combustion engines. An object of this invention is to provide an antipollution internal combustion engine which is superior in exhaust gas properties.

The internal combustion engine provides power through the burning operation of gas mixture between air and hydrocarbon fuels such as gasoline, petroleum gas, etc. As shown in FIG. 1, the respective concentrations of exhaust gas constituents such as nitrogen oxides ($NO_x$), carbon monoxide (CO) and hydrocarbons (HC), etc. which are discharged from the internal combustion engine, vary in accordance with an excess air ratio F (which means a ratio of an air fuel ratio to an equivalent air fuel ratio, the air fuel ratio indicating a ratio of air mass and fuel mass, the equivalent air fuel ratio indicating an air fuel ratio provided that $H_2O$ and $CO_2$ have been produced stoichiometrically through reaction of the fuel and the oxygen. Accordingly, the smaller the value of the excess air ratio F is, the higher the fuel concentration is. The greater the value of the excess air ratio F is, then the lower the fuel concentration is). For example, the gas mixture in the range of $0.9 < F < 1.25$ produces a large quantity of NOx due to high combustion temperatures (approximately 2,000° K to 3,000° K). The gas mixture in the range of $F < 0.9$ produces relatively small quantity of $NO_x$, but an extremely large amount of CO and HC. Accordingly, in order to improve the exhaust gas properties to develop antipollution internal combustion engines, it is required to burn lean gas mixture in the range of $F > 1.25$, or to effect exhaust gas recirculation (EGR) to make fuel concentration lean to lower the combustion temperature of the gas mixture down to approximately 1,500° K or less.

In the conventional thin electrode type spark-plug, for example, a spark-plug shown in FIG. 5 and by Table 1, line W, which comprises a grounded electrode 1 composed of wide and long plate and with a high-tension electrode 2 of thin cylinder with flat end face, has, as shown in FIG. 42, extremely narrow ignitable region (a region below the curve). FIG. 42 shows the relationship of the ignition-limit excess air ratio $F_L$ of the gas mixture under 1 atmospheric pressure and room temperature vs. the electrode gap distance, namely, spark gap $L_s$. As seen from FIG. 42, in the conventional spark-plug, the ignition of the lean gas mixture in the range of the $F > 1.25$ can be realized only when the spark gap is greater than $L_s^* = 2.28$m ( the $L_s^*$ shows a measured ignitable spark gap for an excess air ratio of ignition-limit of $F_L = 1.25$).

Table 1

| Marks of $F_L$-$L_s$ Characteristic Curves | Types of Electrodes | (Prior art) Grounded Electrode Dimensions (mm) | High-Tension Electrode Dimension (mm) | $L_s^*$ (mm) |
|---|---|---|---|---|
| W | Fig. 5 | 2.7 width<br>1.3 thickness<br>5 length | 1.0 diameter | 2.28 |
| W' | Fig. 6 | 2.7 width<br>1.3 thickness<br>5 length | 1.0 diameter | 2.04 |

Also, as in the other conventional spark-plug of FIG. 6 and Table 1, line W', according to a thin electrode type spark-plug which comprises the same high-tension electrode 2 as that of FIG. 5, and a grounded electrode 1 with U-shaped groove 1' along the lengthwise direction of the discharging plane on the wide and long plate, the characteristic curves between the excess air ratio $F_L$ of ignition-limit and the electrode gap distance $L_s$ are improved as compared with the curve W, as apparent from the curve W' of FIG. 42. However, the ignitable region is so narrow that the ignition of the lean gas mixture in the range of the $F > 1.25$ can be realized only when the electrode gap distance is greater than $L_s^* = 2.04$ mm.

In using an ignition power supply on the market, dischargeable-limit gap distance Ls for discharge with two-electrode type plug is about 2 mm for a gas mixture (gas mixture on heavy loading of the internal combustion engine with a compression ratio of approximately 10), which is compressed into molar density as eight times high as that under one atmospheric pressure. Accordingly, in the conventional spark-plugs, it has been difficult to directly ignite the lean gas mixture where $F > 1.25$. In order to eliminate such difficulty, the following three methods have been proposed.

A torch igniting means has been considered as a first method, according to which an antipollution internal combustion engine is realized by use of spark-plugs of the prior art. The torch makes it possible to ignite such lean gas mixture that has an air fuel ratio at the explosion limit. Accordingly, by making the gas mixture only near the spark-plug high in fuel concentration to effect the igniting operation, the excessively lean gas mixture (on the whole) can be burned through the formation of the torch. However, the disadvantages with the above torch ignition means are that combustion subchamber, and subcarburetor, or extra fuel injected system, etc. are required to realize the above-described burning operation of the lean gas mixture.

Secondly, it is also possible to take measures for individual operation modes. During starting and warming-up operations, idling (no-load) operation and engine-braking (negative load operation), less $NO_x$ are produced independently of the value of the excess air ratio F, because of the low temperature and low pressure of the gas mixture. However, in such modes an F valve of nearly equal to 1 or smaller is required to assure igniting operation. Thus, the number of revolutions of the engine in idling mode has to be high to ensure $F \approx 1$, and hence, the fuel consumption increases adversely. In the heavy loading operation mode and the others than the above mentioned modes, temperature and pressure of the gas mixture is high, and therefore, the lean gas mixture in the range of approximately $F = 1.2$ or smaller can be spark-ignited. Accordingly, the less $NO_x$ is produced with $F \approx 1.2$ and simultaneously better heat transfer rate through the cylinder wall of the engine. The disadvantage of such individual-operation-mode measure is that the internal combustion engines should provide a system that the value of the excess air ratio F is to be adjusted and controlled in the extremely narrow allowable value range for every operation mode.

Thirdly, it is possible to provide an internal combustion engine wherein an excessively rich gas mixture (on the whole) is ignited to burn at relatively low temperature for preventing the $NO_x$ production and CO and HC are rear-treated through the use of catalyst or thermal reactor. However, in order to realize the above requirements, rear-treating system including catalyst, thermal reactor, air pump, catalyst antioverheat equipment, etc. are required, thus resulting in power loss in exhaust system increased fuel consumption due to excessively rich fuel, sulfuric acid mist and scattering heavy metal.

The internal combustion engines used in the above-mentioned first, second and third methods have such disadvantages as increased weight and cost of the engines, complicated adjustment of the optimum operating conditions of the engines, inferior stability of the optimum operation, difficulyt mass production controlling, and complicated, difficult adjustment of the mammeo us use.

SUMMARY OF THE INVENTION

This invention is characterized by constructing first and second electrodes of the electric spark-plugs for internal combustion engines in a manner that the thermal conductance G of the below mentioned ignition condition inequality (1) expressed in relation to the excess air ratio F of the gas mixture is made as small as possible through decreasing of fluid resistance with respect to the minute flame nucleus gas flow.

$$J > \frac{G}{V}\left\{\frac{\exp(E_b/RT)}{(\alpha-1)B\epsilon^{n+m^*}}\cdot\frac{(n+4.773\,mF)^{n+m^*}}{3.773^{\gamma m}\,n^n m^{m^*}(X_t-X_i)^{n+m^*}F^{m^*}}\right\} \quad (1),$$

wherein symbols in the inequality (1) are as follows: J, $\epsilon$ and $m^*$ expressed as follows:

$$J = [E_b(T_s - T_o) + RT_s^2] / \pi RT_s^2,$$

$$\epsilon = [(760 - P^-) / 760]\,Rc,$$

$$m^* = (1 + \gamma)\,m,$$

wherein V represents the volume of the flame nucleus, T is its temperature, G is the thermal conductance from the flame nucleus to the electrodes of the temperature $T_o$, $X_i$ is a molar density (converted in 1 atmospheric pressure) if incombustible gases, other than nitrogen, of the gas mixture, F, $\epsilon$, $p^-$ and Rc are excess air ratio, density index of molecules, absolute value of negative pressure (mm Hg) in intake pipe, and compression ratio at the time of ignition, respectively, in the gas mixture. The dependences of the singular point temperature $T_s$ upon the variable quantities V, G, X;, F and $\epsilon$ are sufficiently small, and therefore, practically, J is regarded as a constant. $E_b$ is the activation energy of rate constant of chain branching concerning the fuel to be used, n and m are the molecularities of reaction of fuel and oxygen, respectively, that is, the power indices of the rate terms of fuel molecule and of oxygen molecule, respectively, in the rate equations of reaction (5) and (6). $\gamma$ is a parameter sjhowing the participation degree of nitrogen molecules in reaction process, $\gamma$ is a multiplication factor of chain carriers, R is a gas constant, B, $X_t$ and $\pi$ are constants, respectively.

According to the present invention electric spark-plug for automobile internal combustion engines is provided which can ignite the lean gas mixture even under the severe conditions of room temperature, 1 atmospheric pressure and excess air ratio F of approximately 1.25 or more.

The use of the spark-plug according to this invention can realize so-called antipollution automobile engines of lean gas mixture combustion type, which exhaust less HC, CO and $NO_x$, through provision of a known gas mixture producing device which produces lean gas mixture of F ≧ 1 in operation modes including idling, engine-braking, constant speed, acceleration and deceleration.

BRIEF EXPLANATION OF THE DRAWING

FIG. 8 to FIG. 14, FIG. 17 to FIG. 26, FIG. 29, FIG. 32, FIG. 34 to FIG. 36 show the other embodiments of the two-electrode spark-plug of the present invention, the respective (a) and (c) thereof showing the sectional side view of the essential parts and the sectional front view, the respective (b) thereof being the bottom view.

FIG. 27, FIG. 28, FIGS. 30, 31 and 33 show the enlarged views of the electrode essential parts of the spark-plugs of the present invention, respectively, the respective (a) and (b) of FIG. 27 and FIG. 28 being the sectional side view and the top view, the (c) of FIG. 28 being the sectional front view, the respective (a), (b) and (c) of FIG. 30, FIG. 31, and FIG. 33 being the sectional side view, the top view, and the sectional front view.

DETAILED DISCLOSURE OF THE INVENTION

Figure 1:
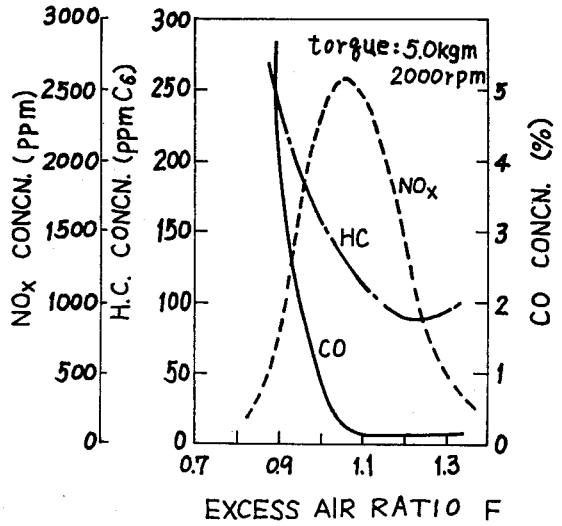
FIG. 1 is a graph showing the relationships of the $NO_x$ concentration (by parts per million, i.e., ppm, graduated on the left ordinate) in the exhaust gas, the HC concentration (by hexane equivalent ppm, graduated on the left ordinate) therein and the CO concentration (by %, graduated on the right ordinate) therein, respectively, with respect to the excess air ratio F (abscissa) of the gas mixture in the internal combustion engine.

A new theory concerning growth or decay of the initial flame nucleus, which determines the success or failure of the electric spark ignition of the combustible gas mixture, is as follows: Namely, the model of micro chain reaction has been established to analyze the model mathematically. Not only elements governing the ignition limit, such as gas mixture temperature, density index of molecules, excess air ratio F, incombustible gas density, flame nucleus volume, and thermal conductance G to electrodes, but also the relationships among them have been clarified. A new concept has been introduced wherein high speed fluid motion named "electro-flame-wind" is caused at the time of the spark discharging. As a result, the fluid resistance of the electrodes play a principal part for the thermal conductance G, and the electrodes, which are adapted to have small fluid resistances, can ignite the lean gas mixture. This invention is embodied, based on this theory.

It is an object of this invention to provide electric spark-plug for automobile internal combustion engines, based on the above new theory, which is capable of directly igniting the lean gas mixture, and antipollution automobile internal combustion engines of lean gas mixture combustion type which are superior in exhaust gas characteristics.

It is also an object of this invention to provide a method of igniting an automobile internal combustion engine of lean gas mixture combustion type, based on the above new theory, which is the method of directly igniting the lean gas mixture, thereby easily to realize the antipollution automobile internal combustion engines which are superior in exhaust gas characteristics.

This invention will be described hereinafter in detail with reference to the theory and embodiments.

(A) Theory

In the following, the new theory concerning the electric spark ignition of the combustible gas mixture will be described in five steps. First, five steps are summarized:

(1) first step (model of micro chain reaction)

First, the model of reaction scheme of the chain combustion in the initial flame nucleus is made to establish the equations which determine chain carrier molar density X in the flame nucleus and the behaviour of the temperature T.

(2) second step (derivation of ignition conditional inequality)

The equations obtained in the above step is analyzed by use of a known Liapunov's stability theorem to derive the ignition conditional inequality.

(3) third step (derivation of ignition conditional inequality expressed in the excess air ratio F)

The dependence of ignition conditional inequality on the mixing ratio obtained in the second step is examined about the gas mixture composed of air, fuel, inert gases except nitrogen to rewrite the ignition conditional inequality in the expression of the excess air ratio F.

(4) fourth step (examination of dependence of excess air ratio of ignition limit on each parameter)

In accordance with the ignition conditional inequality obtained in the third step, the dependence of the ignition limit excess air ratio, upon the gas mixture temperature T, upon the density index $\epsilon$ of molecules thereof, upon the incombustible gas molar density $X_i$ thereof, upon the flame nucleus volume V thereof, and upon the thermal conductance G to the electrodes, particularly the dependence upon the flame nucleus volume V and the thermal conductance G to the electrodes is examined in detail.

(5) fifth step (relationship between thermal conductance G and fluid resistance of electrode(s))

Finally, the proportional relationship between the thermal conductance G and the fluid resistance $\Sigma$ of the electrodes is clarified hydrodynamically. As a result, since the thermal conductance G becomes small proportionally as the fluid resistance $\Sigma$ becomes small accordingly, the lean gas mixture ignition can be possible. At the same time, the reasons why the conventional spark-plugs can not ignite the lean gas mixture are described. Now, the steps are described in detail.

FIRST STEP (MODEL OF MICRO CHAIN REACTION)

There exists a nucleating volume (volume V, temperature T), that is, a minute space, in which the enlargement of the pre-expolsion flame (flame nucleus) formed around discharge channel is limited. In this or smaller volume, no significant local heating can take place and the molar density of the chain carrier does not increase so fast as to cause an explosion. Assume that in the volume, the molar densities (mol/cm$^3$) of the chain carrier, fuel, oxygen and nitrogen are X, $\epsilon X_f$, $\epsilon X_{ox}$ and $\epsilon X_{ni}$, respectively. Therein, $\epsilon$ is a density index of molecules expressed in the following equation:

$$\epsilon = \frac{760 - p^-}{760} \cdot Rc \quad (2),$$

wherein $p^-$ is an absolute value (mm Hg) of negative pressure in intake pipe, Rc being a compression ratio at the time of ignition.

The reaction scheme of the branched-chain combustion in the nucleating volume is as follows.

$$n\,(\text{fuel}) + m\,(\text{ox}) + \gamma m\,(\text{ni}) + (\text{chain carrier})\ {}^{k}\text{b}\ (\text{inactive products}) + \alpha \cdot (\text{chain carrier}) \quad (3),$$

$$(\text{chain carrier})\ {}^{k}\text{t}\ (\text{inactive products}) \quad (4),$$

wherein ox is oxygen, *ni* is nitrogen in the air, $k_b$ and $k_t$ are the rate constants for branching and termination, respectively, $\alpha$ is a multiplication factor of chain carrier, n and m are the molecularities of reaction of fuel and oxygen, respectively (the power indices of the rate terms of fuel molecule and of oxygen molecule, respectively, in the rate equation of reaction). The incombustible molecules such as nitrogen, etc. are also constituents of the conservation system of kinetic energy and momentum produced through the collision reaction between the fuel molecules and the oxygen molecules. Participation of the incombustible molecules in this conservation system is not always effected after the reaction of the fuel and the oxygen has been terminated. Therefore, it is reasonable to consider that the participation is performed even in the way to the reaction. The direct participation of the nitrogen molecules in the combustion process should be considered particularly under conditions where $NO_x$, even if very small in amount, may be produced. The number of the nitrogen molecules participated in the reaction is assumed to be above-described $\gamma m$ (*ni*). Generally, $\gamma$ is 3.773 (a molar concentration ratio of the nitrogen in the atmosphere to the oxygen therein) or less.

From the reaction formulas (3) and (4), the kinetic equation concerning the molar density of chain carrier and the energy conservation equation are expressed in the following equations (5) and (6), respectively:

$$\begin{cases} \dfrac{dX}{dt} = \{(\alpha - 1)(\epsilon X_f)^n(\epsilon X_{ox})^m(\epsilon X_{ni})^{\gamma m}k - k_t\}\,X & (5), \\ \dfrac{dT}{dt} = \dfrac{X}{\rho c_s}\{(\alpha - 1)(\epsilon X_f)^n(\epsilon X_{ox})^m(\epsilon X_{ni})^{\gamma m}k\Delta H_b + k_t\Delta H_t\} - \dfrac{G}{V\rho c_s}(T - T_o) & (6), \end{cases}$$

wherein $t$ is time, $\rho$ is the density of the gas mixture, $c_s$ is average specific heat of the gas mixture, $\Delta H_b$ and $\Delta H_t$ are the reaction enthalpy of the chain branching and chain termination, respectively. The thermal conductance from the nucleating volume, namely, the flame nucleus to the spark-plug electrodes (temperature $T_o$) is assumed to be G. Also, the temperature dependence of $k$ is assumed to follow the usual Arrhenius' equation $k = B \exp(-E_b/RT)$, (wherein B is a constant, $E_b$ is activation energy for branching, R is a gas constant), but $k_t$ is assumed to be independent on the temperature.

In the actual combustion reaction, the chain reaction shown in the eq. (5) and the thermal reaction shown in the eq. (6) proceeds simultaneously. Accordingly, we deal simultaneously with the two equations (5) and (6) to obtain the conditions of ignition, namely, the conditions where flame nucleus will not go out. If all of $X_f$, $X_{ox}$ and $X_{ni}$ are sufficiently larger than X, and the changes of all of $X_f$, $X_{ox}$, and $X_{ni}$ are negligible as compared with the change of X, the reaction becomes a pseudofirst order reaction. Therefore, in this case by writing $$K_b = (\alpha - 1)b(\epsilon X_f)^n(\epsilon X_{ox})^m(\epsilon X_{ni})^{\gamma m}\exp(-E_b/RT) \quad (7),$$

$$\Delta H_b/\Delta c_s = h_b,\ \Delta H_t/\Delta c_s = h_t \quad (8),$$

the equations (5) and (6) can be simplified as follows:

$$\begin{cases} \dfrac{dX}{dt} = (k_b - k_t)X & (9), \\ \dfrac{dT}{dt} = (k_b h_b + k_t h_t)X - \dfrac{G}{V\rho c_s}(T - T_o) & (10). \end{cases}$$

SECOND STEP (DERIVATION OF IGNITION CONDITIONAL INEQUALITY)

Since the equations (9) and (10) contain no independent variable explicitly on the right side, a phase (T — X) plane method can be used to examine the behavior in a phase plane. The following equation can be obtained by writing the left side of the equations (9) and (10) as $f$ and $g$, respectively, $$\frac{g}{f} = \frac{dT}{dX} = \frac{(k_b h_b + k_t h_t)X - \dfrac{G}{V\rho c_s}(T - T_o)}{(k_b - k_t)X} \quad (11).$$

The singular points of this equation are obtained by solving the following simultaneous equations:

$$\begin{cases} (k_b - k_t)X = 0 & (12), \\ (k_b h_b + k_t h_t)X - \dfrac{G}{V\rho c_s}(T - T_o) = 0 & (13). \end{cases}$$

We denote the coordinates of the singular points by $X_s$, $T_s$) and $X - X_s$ and $T - T_s$ are used as new variables, respectively, to enable the eq. (11) to be linearized in the neighborhood of the singular points. So, we transform $X - X_s$ and $T - T_s$ to X and T, respectively, as f and g to become both 0 in the origin of the coordinates (0,0). If the f and g have second derivatives at the origin, according to the Taylor's theorem, the following equation should hold:

$$g(X, T) = g(O, O) + g_X(O, O)X + g_T(O, O)T + \tfrac{1}{2}\{g_{XX}(\xi, \zeta)X^2 + 2g_{XT}(\xi,\zeta)XT + g_{TT}(\xi, \zeta)T^2\} \quad (14),$$

wherein $g_x = \delta g/\delta X$. $g_T = \delta g/\delta T$, $g_{XX} = \delta^2 g/\delta X^2$. $g_{XT} = \delta^2 g/\delta X\delta T$, $g_{TT} = \delta^2 g/\delta T^2$, $\xi = \omega X$, $\zeta = \omega T (O < \omega < 1)$. Accordingly, in the neighborhood of the origin, namely, in a location where $|X|$ and $|T|$ are small, g(X, T) are approximated as follows:

$$g(X, T) = \Gamma_1 X + \Gamma_2 T, \text{ wherein } \Gamma_1 = g_X(O, O),\ \Gamma_2 = g_T(O, O) \quad (15).$$

Likewise, $f(X, T)$ is also approximated as follows:

$$f(X, T) = \Gamma_3 X + \Gamma_4 T, \text{ wherein } \Gamma_3 = f_X(0, O),\ \Gamma_4 = f_T(0, O) \quad (16),$$

Accordingly, the eq. (11) is expressed as follows:

$$\frac{dT}{dX} = \frac{\Gamma_1 X + \Gamma_2 T}{\Gamma_3 X + \Gamma_4 T} = \frac{RT_s^2 (k_t h_t + k_b h_b)X + (X_s k_b E_b h_b - \beta)T}{RT_s^2 (k_b - k_t)X + (X_s k_b E_b)T} \quad (17)$$

wherein $$\beta = RT_s^2 \left[ \frac{\delta}{\delta T} \left\{ \frac{G}{V\rho c_s} (T - T_o) \right\} \right] (T = T_s).$$

The nature of the singularity is found by examining the characteristic equation associated with the eq. (17), i.e., $$\lambda^2 - (\Gamma_2 + \Gamma_3)\lambda + \Gamma_2\Gamma_3 - \Gamma_1\Gamma_4 = O \quad (18),$$

the roots of which are $$\lambda + = \frac{(\Gamma_2 + \Gamma_3) + \sqrt{(\Gamma_2 - \Gamma_3)^2 + 4\Gamma_1\Gamma_4}}{2}, \quad (19).$$

and $$\lambda - = \frac{(\Gamma_2 + \Gamma_3) - \sqrt{(\Gamma_2 - \Gamma_3)^2 + 4\Gamma_1\Gamma_4}}{2}$$

If $\lambda+$ and $\lambda-$ are both real and differing in sign (i.e. $\Gamma_2\Gamma_3 - \Gamma_1\Gamma_4 < O$), that particularly singularity is a "saddle point" and unstable. At this time, the T and X diverge. Physically, the flame nucleus does not go out and the combustion spreads to the entire gas mixture. Namely, it means that the ignition (explosion) occurs. The conditions for this is $\Gamma_1\Gamma_4 > \Gamma_2\Gamma_3$. Namely, the following equation is given:

$$(k_b h_b + k_t h_t) X_s K_b E_b > (k_b - k_t)(X_s k_b E_b h_b - \beta) \quad (20).$$

This is an inequality expressing the ignition (explosion) condition. $\beta = RT_s^2(G/V\rho c_s)$ is substituted into the above equation and the both sides of the inequality are divided by $RT_s^2$ to obtain the following inequality:

$$k_b k_t (h_b + h_t) X_s \frac{E_b}{RT_s^2} > \frac{(k_t - k_b)}{V\rho c_s} G \quad (21).$$

The eq. (7) is substituted into the inequality (21) and the both sides of the inequality are multiplied by $V\rho c_s$ to obtain the following inequality:

$$k_b k_t (\Delta H_b + \Delta H_t) X_s \frac{E_b}{RT_s^2} V > (k_t - k_b) G \quad (22).$$

The inequality (22) can be expressed as $$(\Delta H_b + \Delta H_t) X_s \frac{E_b}{RT_s^2} > \frac{G}{V} \left( \frac{1}{k_b} - \frac{1}{k_t} \right) \quad (23)$$

One of singularities which simultaneously satisfy the equations (12) and (13) is obviously $(X_s, T_s) = (O, T_o)$. This is a stable nodal point, but is not a saddle point. The relationship between $X_s$ and $T_s$ is obtained for another singularity (saddle point). From $X_s \neq O$ and the eq. (12) the following equation is obtained:

$$k_b = k_t \quad (24)$$

The equation (24) is substituted into the eq. (13) to hold:

$$X_s = \frac{G}{V} \frac{(T_s - T_o)}{k_b(\Delta H_b + \Delta H_t)} \quad (25).$$

On the other hand, the termination of the chain carrier is mainly due to collision deactivation against the electrode face. Chain carriers (particles) reach the electrode face and are annihilated, and simultaneously the carried heat energies are transferred to the electrode. Since the mass flow and the heat flow are performed through the same molecular mechanism, the rate constant $k_t$ of the termination is proportional to the thermal conductance G. Since the flame nucleus volume V is considered to increase in proportion to the spark gap $L_s$ and the electrode annihilation of the chain carriers grows out of the end of the nucleus volume V near the electrode face, the decreasing rate of the average density of chain carrier over the nucleating volume is in inverse proportion to $L_s$, accordingly to V.

The $k_t$ is given by $$k_t = \pi(G/V) \quad (26)$$

Wherein $\pi$ is a constant. The equations (25) and (26) are substituted into the inequality (23) to obtain the following equation:

$$\frac{E_b(T_s - T_o) + RT_s^2}{\pi RT_s^2} > \frac{G}{V} \frac{1}{K_b} \quad (27)$$

On the other hand, from the equations (7), (24) and (26) and under the conditions of $T = T_s$, the following equation is obtained:

$$\exp\left(-\frac{E_b}{RT_s}\right) = \frac{G}{V} \cdot \frac{\pi}{(\alpha - 1)B(\epsilon X_f)^n(\epsilon X_{ox})^m(\epsilon X_{ni})^{\gamma m}} \quad (28)$$

Although $T_s$ depends upon (G/V) or $[(\epsilon X_f)^n(\epsilon X_{ox})^m(\epsilon X_{ni})^{\gamma m}]^{-1}$, the dependency of the $T_s$ on them is extremely small. For example, as typical $E_b$ and $T_s$ in the actual combustion reaction, in the neighborhood of $E_b = 50$ Kcal/mol, $T_s = 500$ K, if (G/V) or $[(\epsilon X_f)^n(\epsilon X_{ox})^m(\epsilon X_{ni})^{\gamma m}]^{-1}$ increases twice, $T_s$ increases only by 1.4%. Namely, the left side in the inequality (27) can be considered to be a constant independent from (G/V) or a mixing ratio, and hence, by writing it as J, the ignition condition is given by $$J > (G/V)(1/k_b) \quad (29)$$

Considering $X_{ni} = 3.773\ X_{ox}$ in the atmosphere, the eq. (7) is substituted into the inequality (29) to obtain the following inequality:

$$J > \frac{G}{V} \cdot \frac{\exp(E_b/RT)}{(\alpha - 1)B3.773^{\gamma m}\epsilon^{n + (1+\gamma)m} X_f^n X_{ox}^{(1+\gamma)m}} \quad (30).$$

Third Step (derivation of the ignition conditional inequality of the excess air ratio representation)

The gas mixture which consists of air, fuel and incombustible gases other than nitrogen is examined. The entire molar density of the gas mixture is constant, independently of the mixing ratio. From this condition, the following equation is given $$X_f + X_{ox} + X_{ni} + X_i = X_f + 4.773\,X_{ox} + X_i = X_t = \text{Const} \quad (31),$$

wherein $X_i$ is the molar density of incombustible gases, other than nitrogen, contained in the nucleating volume when $\epsilon = 1$. Now, the excess air ratio F is defined as shown in the following equation:

$$F = \frac{\frac{M_A}{M_f}}{\left(\frac{M_A}{M_f}\right)_{st}} \quad (32),$$

wherein $M_A/M_f$ is an air fuel ratio (a mass ratio of air to fuel), $(M_A/M_f)_{st}$ is an air fuel ratio of an equivalent gas mixture. The air fuel ratio $M_A/M_f$ can be expressed in the following equation:

$$\frac{M_A}{M_f} = \frac{X_{ox}\mu_{ox} + X_{ni}\mu_{ni}}{X_f\mu_f} = \frac{X_{ox}(\mu_{ox} + 3.773\,\mu_{ni})}{X_f\mu_f} = \frac{X_{ox}}{X_f}\cdot\frac{\mu_a}{\mu_f} \quad (33),$$

wherein the molecular weight of the fuel, oxygen, and nitrogen are $\mu_f$, $\mu_{ox}$, and $\mu_{ni}$, respectively, and $\mu_a = \mu_{ox} + 3.773\,\mu_{ni}$. On the other hand, in the equivalent gas mixture, $X_{ox}/X_f = m/n$ is provided, and thus the fuel ratio of the equivalent gas mixture is given from the eq. (33) by the following equation:

$$\left(\frac{M_A}{M_f}\right)_{st} = \frac{m}{n}\,\frac{\mu_a}{\mu_f} \quad (34).$$

Resultantly, from the equations (32), (33) and (34), F is given by the following equation:

$$F = \frac{n}{m}\,\frac{X_{ox}}{X_f} \quad (35).$$

$X_f$ and $X_{ox}$ are given, from the equations (31) and (35), as the following equation:

$$X_f = \frac{n(X_t - X_i)}{n + 4.773\,mF},\quad X_{ox} = \frac{m(X_t - X_i)F}{n + 4.773\,mF} \quad (36).$$

The eq. (36) is substituted into the inequality (30) to express the ignition condition by the following inequality:

$$J > \frac{G}{V}\left\{\frac{\exp(E_b/RT)}{(\alpha - 1)B\epsilon^{n+(1+\gamma)m}}\cdot\frac{(n + 4.773\,mF)^{n+(1+\gamma)m}}{3.773^{\gamma m}\,\eta^n m^{(1+\gamma)m}(X_t - X_i)^{n+(1+\gamma)m}F^{(1+\gamma)m}}\right\} \quad (1').$$

This ignition conditional inequality means the easier the ignition becomes as the smaller the right-hand side becomes.

Now, by defining $Z(T, \epsilon, Y)$ and $Y(F, X_i)$ as follows:

$$Z(T, \epsilon, Y) = \frac{\exp\left(\frac{E_b}{RT}\right)}{(\alpha - 1)B\epsilon^{n+(1+\gamma)m}}\cdot Y \quad (37),$$

$$Y(F, X_i) = \frac{(n + 4.773m\,F)^{n+(1+\gamma)m}}{3.773^{\gamma m}\,n^n m^{(1+\gamma)m}(X_t - X_i)^{n+(1+\gamma)m}F^{(1+\gamma)m}} \quad (38),$$

the condition of ignition can be simplified as follows:

$$J > (G/V)\,Z(T, \epsilon, Y) \quad (39).$$

Accordingly, the ignition limit condition given by $$J = (G/V)\,Z(T, \epsilon, Y) \quad (40).$$

Fourth Step (examination of the dependences of ignition limit excess air ratio on each parameter)

(a) With regard to parameters G and V of ignition limit conditional equation (40).

Figure 2:
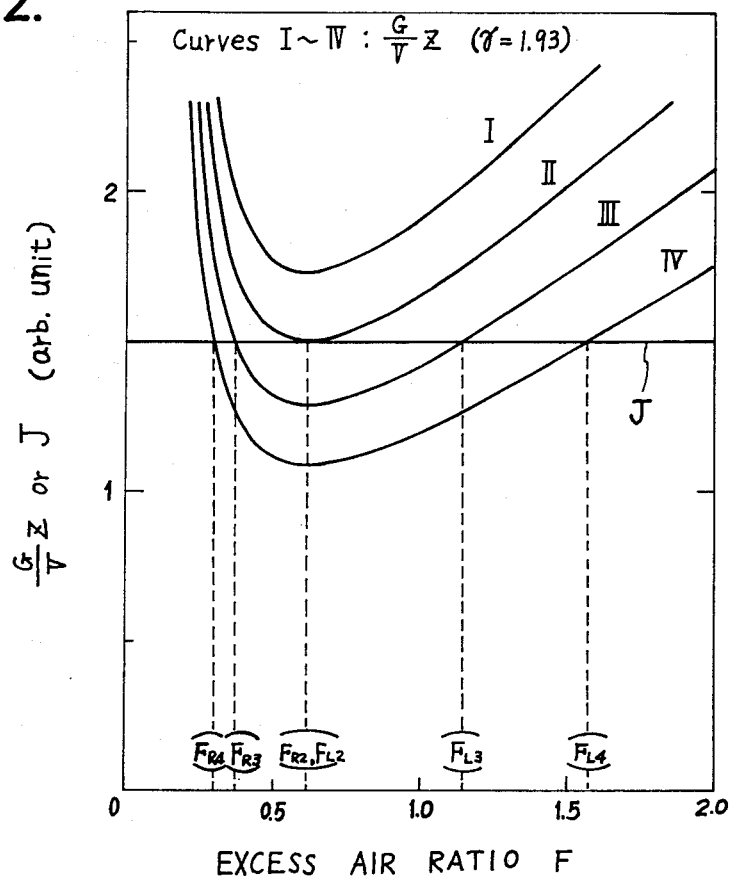
FIG. 2 is a graph showing the relationship, in one example, among the left and right sides of the ignition theoretical inequality (1) of the inventors and the excess air ratio F, with (G/V) as a parameter.

Dependence on F of (G/V)Z in the right side of the eq. (40) is expressed through the $Y(F, X_i)$ in the eq. (38) and the $Z(T, \epsilon, Y)$ of the eq. (37). In FIG. 2, curves I to IV show one example of $(G/V)Z - F_L$ characteristic curve group with various numerical values of G/V which is optionally selected to be listed in Table 2. The left side of the eq. (40) is independent of the value F, and therefore can be expressed by a horizontal line J. A curve I does not cross the horizontal line J. In this (G/V) = 1.000 case, the ignition is not effected in any mixing ratio. (G/V)Z curve moves downwardly when (G/V) is made small to 0.867, and the curve II and the horizontal line J comes to contact with each other at one point, thus allowing the ignition to be effected only at the excess air ratio of $F = F_{R2} = F_{L2}$. If the (G/V) is made smaller to 0.743, the (G/V)Z cure moves further downwardly so that the curve may cross the horizontal line J at two points, $F = F_{R3}$ and $F_{L3}$. Thus, the ignitable region is $F_{R3} < F < F_{L3}$. In the case where (G/V) = 0.629 (curve IV), the ignitable region is further enlarged to $F_{R4} < F < F_{L4}$. Thus, if the parameter (G/V) is reduced under a given limit, the ignitable region can be enlarged to the lean mixture (and the rich mixture).

Table 2

(relative values of V for various curves)

Figure 3:
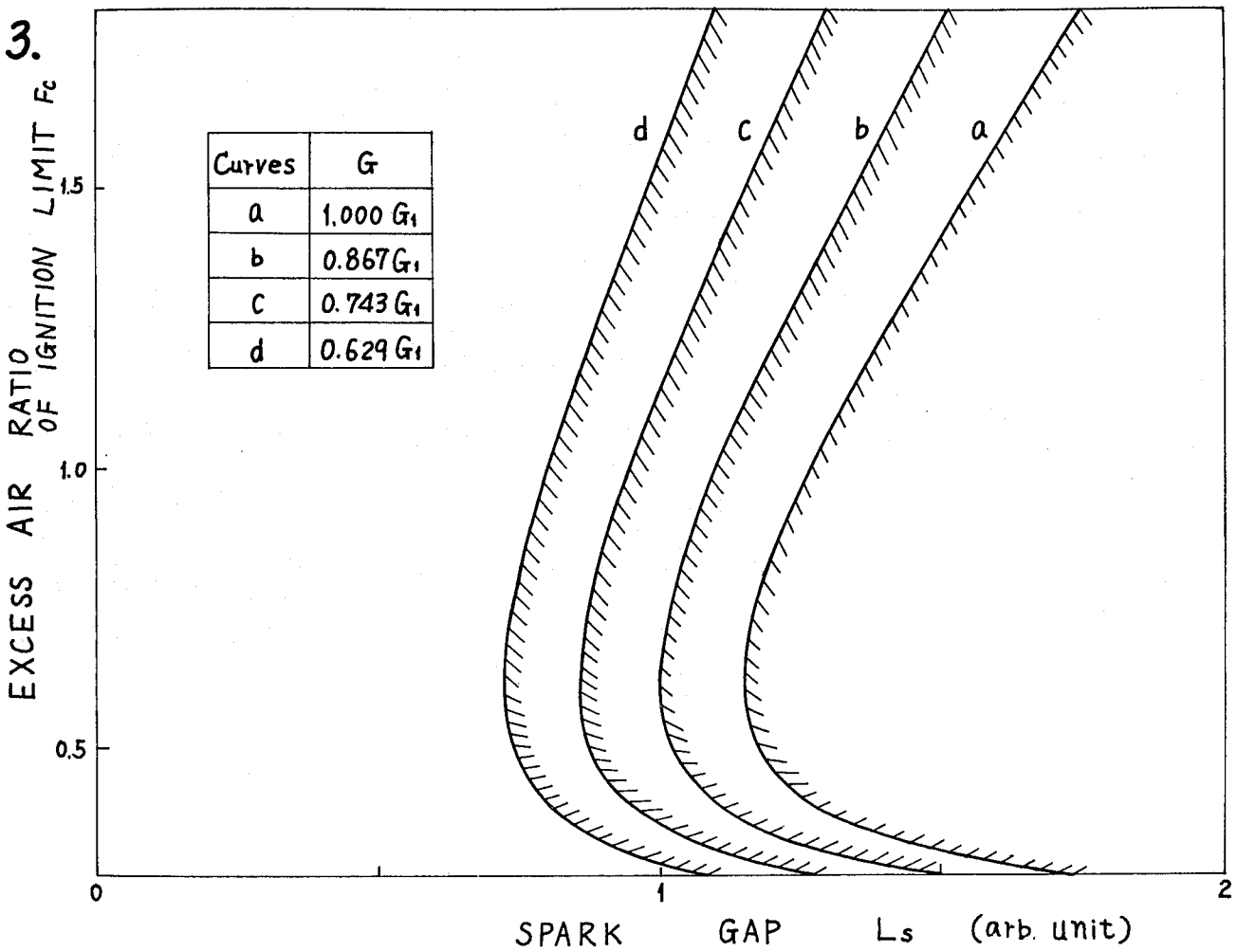
FIG. 3 is a graph showing the relationship, in one example, between the ignition limit excess air ratio $F_c$ and the electrode gap distance $L_s$, with G of the inequality (1) as a parameter, being based on the calculations from FIG. 2, the shaded region being the ignitable region.

| Curves in Fig. 2 \ Curves in Fig. 3 | a ($G=1.000G_1$) | b ($G=0.867G_1$) | c ($G=0.743G_1$) | d ($G=0.629G_1$) |
|---|---|---|---|---|
| I ($\frac{G}{V}$ = 1.000) | 1.000 | 0.867 | 0.743 | 0.629 |
| II ($\frac{G}{V}$ = 0.867) | 1.154 | 1.000 | 0.857 | 0.726 |
| III ($\frac{G}{V}$ = 0.743) | 1.346 | 1.167 | 1.000 | 0.847 |

Table 2-continued

| Curves in Fig. 2 \ Curves in Fig. 3 | a ($G=1.000G_1$) | b ($G=0.867G_1$) | c ($G=0.743G_1$) | d ($G=0.629G_1$) |
|---|---|---|---|---|
| | (relative values of V for various curves) | | | |
| IV ($\frac{G}{V}=0.629$) | 1.591 | 1.379 | 1.182 | 1.000 |

Accordingly, under a condition where G is constant, if the V is made larger, the excess air ratio $F_L$ of the lean mixture side ignition limit can be made larger and the excess air ratio $F_R$ of the rich mixture side ignition limit can be made smaller. On the other hand, under a condition where the V is constant, if the G is made smaller, the $F_L$ can be made larger and the $F_R$ can be made smaller. This description will be given in detail in the below mentioned fifth step.

Then, dependence of the $F_R$ and $F_L$ upon the V, hence, dependence upon the electrode gap distance Ls, will be examined hereinafter. Assume that the nucleating volume size V is increased in proportion to the electrode gap distance Ls, namely, $$V = \theta L_s \tag{41}$$

wherein $\theta$ is a proper constant. The eq. (41), (37) and (38) are substituted into the ignition limit conditional equation (40) to rewrite the equation explicitly. Thus, the eq. (40) is rewritten:

$$J = \frac{G}{V} Z = \frac{G}{\theta L_s}\left[\frac{\exp\left(\frac{E_b}{RT}\right)}{(\alpha-1)B\epsilon^{n+(1+\gamma)m}} \cdot \frac{(n+4.773\,m\,Fc)^{n+(1+\gamma)m}}{3.773^{\gamma m} n^n m^{(1+\gamma)m}(X_t-X_i)^{n+(1+\gamma)m} Fc^{(1+\gamma)m}}\right] \tag{42}$$

wherein Fc is an ignition limit excess air ratio, and hence Fc is equal to $F_R$ or $F_L$.

Each numeral in the columns under *a, b, c* and *d* of Table 2, shows the relative values of V calculated, respectively, corresponding to the curves I to IV of FIG. 2 in the respective cases of $G = G_1$, $G = 0.867\ G_1$, $G = 0.743\ G_1$, $G = 0.629\ G_1$. The curves *a, b, c* and *d* in FIG. 3 are obtainable by converting the V values of Table 2 to the electrode gap distance Ls on the basis of the eq.(41) and then re-plotting the ignition limit excess air ratios Fc of FIG. 2 with respect to Ls. Such curves *a, b, c* and *d* in FIG. 3 correspond to the *a, b, c* and *d* of Table 2. These curves apparently shows that either of leaner mixture gas and richer mixture gas becomes ignitable as the electrode gap distance $L_s$, namely nucleating volume V, increases. Furthermore, if G is made small, the same lean gas mixture becomes ignitable even in a narrower electrode gap distance $L_s$, and also in case of the same electrode gap distance $L_s$, the excess air ratio $F_L$ of the lean mixture side ignition limit can be increased. The ignitable region in the value of each G is a shaded portion in FIG. 3. When F=0.614 (corresponding to an minimum point of the curve II in FIG. 2) is established in each curve *a, b, c* and *d*, the shortest gap distance of ignition limit Lq is provided. The Lq can be derived as follows. The excess air ratio F* corresponding to the minimum point of the curve II in FIG. 2 is given, through solving (dY/dF)=0 by the following equation:

$$F^* = \frac{1+\gamma}{4.773} \tag{43}$$

Referring to the eq. (42), since $Ls = Lq$ is established in $F^*=(1+\gamma)/4.773$, the $Lq$ is expressed by the following equation:

$$Lq = \frac{G}{\theta J}\left[\frac{\exp\left(\frac{E_b}{RT}\right)}{(\alpha-1)B\epsilon^{n+(1+\gamma)m}3.773^{\gamma m}n^n}\left\{\frac{4.773}{(1+\gamma)m}\right\}^{(1+\gamma)m}\left\{\frac{n+(1+\gamma)m}{X_t-X_i}\right\}^{n+(1+\gamma)m}\right] \tag{44}$$

This is the electrode gap distance corresponding to a so-called quenching distance, which has been known experimentally. It is found out from the eq. (44) and FIG. 3 that the gap distance of ignition limit Lq becomes smaller as the G becomes smaller.

It is obvious from FIG. 3 that the ignition limit curve with respect to $F_L$ portion moves leftwards and upwards, and the ignition limit curve with respect to $F_R$ portion moves leftwards and downwards when G becomes small. Namely, the ignition of the same lean gas mixture can be realized with a narrow electrode gap distance Ls if the G is made small. Also, in the case of the same electrode gap distance Ls, the excess air ratio $F_L$ of the lean mixture ignition limit can be increased.

As described hereinabove, the lean mixture ignition is possible when the (G/V) is made small. It also is effective for the lean mixture ignition operation to control the other parameters T, $\epsilon$ and Y in the right side of the eq. (40), thereby to made Z (T, $\epsilon$, Y) small.

(b) with regard to parameters T, $\epsilon$ and Y of ignition limit conditional equation (40).

As apparent from the eq.(37), the higher the $\epsilon$ of the gas mixture is (absolute value $p^-$ of the negative pressure in intake pipe is smaller and compression ratio Rc is larger), or the higher the gas mixture temperature is, then the smaller Z becomes.

Also, apparent from the eq. (38), Y becomes small as the incombustible gas amount $X_i$ is small. Accordingly, the Z becomes small as is clear from the eq. (37). In these cases, as the characteristic curve (G/V)Z moves downwards in FIG. 2, a point of right side intersection $F_L$ moves rightwards so that the leaner gas mixture can be ignited.

However, as described hereinafter, the $\epsilon$, T and $X_i$ are subject to limits, depending upon the actual operating modes of the internal combustion engine. During the engine braking operation or negative load, the absolute value of the negative pressure in intake pipe becomes approximately $p^- = 600$ mm Hg, and thus the density index $\epsilon$ of molecules of the gas mixture in the engine of a compression ratio $R_c=6$ reaches only $\epsilon = 1.26$ even at the top dead center position of the piston. Since the compression ratio of the internal combustion engine is normally $R_c = 6$ to 10, the limit in low density indexes of molecules can be considered $\epsilon \approx 1$. Since the pressure rise accompanied by adiabatic process is hardly produced under the condition of providing $\epsilon \approx 1$, the limit in the gas mixture pressure, which is disadvantageous to the ignition of the actual internal combustion engines, is considered to be equal to 1 atmospheric pressure. Since the temperature of the gas mixture is approximately equal to atmospheric temperature during the starting and warming-up operations of the internal combustion engine, the atmospheric temperatures in very cold districts during the winter are severe temperature conditions to the igniting operation. However, it is difficult to limit the conditions numerically. Since the pressure and the mixing ratio compensate for each other, actually the approximately 20° C(room temperature or normal temperature) can be considered as a reference temperature. Also, as described hereinbefore, when the negative pressure in intake pipe is larger, one portion of the combustion exhaust gas flows backward (forming automatic recirculation of exhaust gases, self EGR) during the overlapping operation of the exhaust and intake valves. Thus, the molar density of the incombustible gases $X_i$ increases. Needless to say, more $X_i$ is increased when the EGR is used through an external recirculation circuit. As described hereinbefore, it is found out that the $\epsilon$, T and $X_i$ are limited by the actual conditions of the internal combustion engine and the condition of the ignition becomes disadvantageous particularly during light load.

In order to control the production of the NOx during acceleration or heavy load in the driving operation of the internal combustion engine, namely, under the high temperature of the gas mixture and/or under the high pressure conditions, the value of F must be larger than around 1.25. It is sufficient for the antipollution combustion that the electric spark can ignite the gas mixture of $F \geqq 1.25$ under the severest igniting condition, 1 atmospheric pressure and normal temperature. The reason why are that the combustion temperature of the lean gas mixture ($F \geqq 1.25$) is low regardless of the operation modes of the internal combustion engine and therefore is not suitable for the condition of the NOx production, and that the excess of oxygen in the lean gas mixture is not suitable for the condition of production of CO and hydrocarbons.

Fifth Step (relationship between thermal conductance G and electrode fluid resistance)

As described in this step, the high speed fluid motion which we called "electro-flame-wind" is caused during the electric spark ignition in the flammable gas mixture. Accordingly, the thermal conductance G from the flame nucleus of temperature T to the electrodes of temperature To has to be determined through hydrodynamical process.

(a) with respect to electro-flame-wind

Combustion of the gas mixture certainly accompanies the fluid motion of gas. The combustion process is not only a chemical phenomenon, but also a hydrodynamical phenomenon. The thermodynamical quantities (temperature, pressure, density, enthalpy, entropy, etc.), which are caused through the gas fluid velocity and the combustion reaction, are subject to laws of conservation of mass, momentum and energy.

In the electric spark ignition, the flame nucleus is made within the electrode gap, and co-exists with discharge during the duration time of discharge. Thus, during this period, the flow of the flame nucleus gases is subject to the influences from not only the thermodynamical quantities, but also electric fields. Namely, it has to be kept in mind that the flow of the flame nucleus gases has influences from the electro-flame-wind in the form, size and arrangement of the electrode and the cation drag thereof, instead of simply having normal vector of the flame surface. According to the experiments of the inventors, voltage across the spark, obtained from oscillogram of the discharge current in case of the electrode gap distance Ls = 0.84 mm, is 960 V at its initial value. Accordingly, the strength of the electric field is estimated to be $1.27 \times 10^4$V/cm. Using the value of mobility 1.9 $cm^2$/V.s of $N_2^+$ ion in $N_2$ gas of 1 atmospheric pressure and 20° C temperature, considering the highest partial pressure of $N_2$ in the gas mixture, then, the drift velocity of $N_2^+$ ion moving from positive electrode to negative electrode becomes 217 m per second. Other ions have approximately the same drift velocities as the $N_2^+$ ion has. Since this drift velocity diffuses even to the neutral molecules through viscosity, the high speed flow of gases moving from the positive electrode to the negative electrode is caused. This flow cannot stay within the spark region due to the continuity and viscosity of the flow. Thus the flow of gas phase is caused in a region around the electrode and the spark.

This is a phenomenon known as electric wind, in incombustible gas. In the inflammable gas mixture, the combustion flame itself is weak plasma, and the cation in the flame before the discharge is terminated also, acts to strengthen the electric wind. This flow has a vector of axial direction going from the positive electrode to the negative electrode. But the flame has a vector in the normal direction of the flame surface, and hence, has a radial vector which is perpendicular to a line connecting the positive electrode and the negative electrode. Hence, the flow which is expressed in a resultant vector of the axial vector and the radial vector is considered to have been produced in the initial stage of the electric spark ignition, namely, within a period (3.7 ms in the above experiment) of the current flowing. The inventors call this flow the "electro-flame-wind". The electro-flame-wind caused in the inflammable mixture has larger expansion than the simple electric wind caused in incombustible mixture has.

The electro-flame-wind is considered as a unique high speed flow, which is different from the simple electric wind, the torch which is flame without the electric discharge, and a simple overlapping of the simple electric wind and the torch. According to the calculations which are based on the experimental data obtained by the inventors, the flow speed reaches $u \approx 33$ m per second.

The Nusselt number Nu concerning a plate of width $w = 1$ and length $\gamma$ is given by $$Nu = 0.686\,(\mathrm{Pr})\sqrt[3]{\frac{u\gamma}{\nu}} \qquad (45),$$

wherein Pr is the Prandtl number, $\nu$ being kinematic viscosity. Considering that the abovementioned equation is applicable even to a cylindrical electrode having flat discharging plane of radius $r = 0.05$ cm, and assuming that the average temperature of the flame nucleus is 1,000° K, then by substituting the Prandtl number of the air, Pr = 0.702 (at 1,000° K), the kinematic viscosity, $\nu$ = 1.201 $cm^2$/s (at 1,000° K), and the above-described electro-flame-wind velocity $\mu \approx 3.3\times10^3$ cm/s into the eq.(45), Nu $\approx$ 7.0 is obtained. Since the physical meaning of the Nusselt number is a ratio of a heat transfer rate in fluid to the heat transfer rate in still fluid, the heat transport in such high speed flow has to be handled hydrodynamically.

(b) with regard to relationship between thermal conductance G and electrode fluid resistance (i.e., fluid drag)

The thermal conductance G mainly depends upon the fluid drag of the electrodes, namely, the fluid resistance which is determined by the form, size and arrangement of the electrodes. The reason therefor will be described hereinafter. Since the success or failure of the ignition is determined by the growth or decay of the flame nucleus of the nucleating volume V, the words "fluid drag of the electrodes" used herein is for the flow of the flame nucleus gas, namely, the electro-flame-wind inside the nucleating volume.

Generally, fluid drag $\Sigma$ working upon an object in viscous fluid is the sum of friction drag $\Sigma_f$ and pressure drag $\Sigma_p$.

$$\Sigma = \Sigma_f + \Sigma_p \tag{46}$$

The pressure drag $\Sigma_p$ is caused through a decrease of surface pressure of object downstream of the point of separation, due to boundary layer separation caused on the object surface. The pressure distribution upstream of the point of separation can be analyzed theoretically, while no method of correctly analyzing the pressure distributions is provided downstream of the point of separation, except that actual measurement is effected.

Figure 4A:
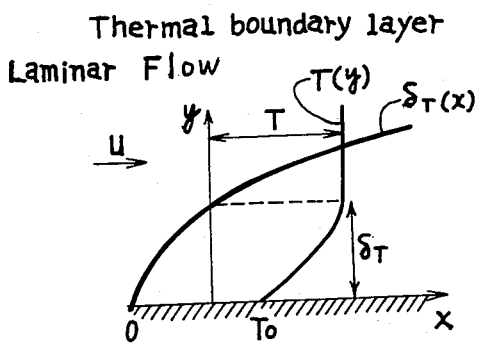
FIG. 4, (a) and (b) are schematic views showing a thermal boundary layer and a hydrodynamic boundary layer formed on the electrode surface by electro-flame-wind, respectively.
Figure 4B:
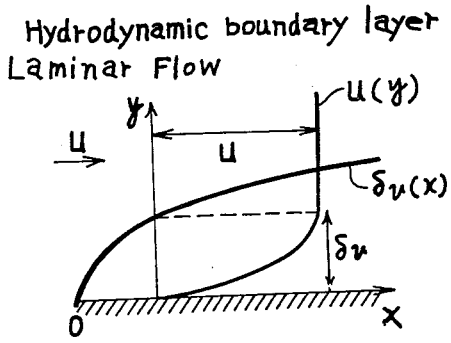

First, a case where the electro-flame-wind is a laminar flow and boundary layer is not separated will be described about symmetrically opposed electrodes with flat plane. In this case, the fluid drag $\Sigma$ of the electrodes is only the friction drag $\Sigma_f$ and can be handled analytically. As shown in FIG. 4, (*a*) and (*b*), an *x* axis (abscissa) is set on parallel to the electrode face and a *y* axis (ordinate) is set in a direction vertical to the electrode face (FIG. 4 shows the sectional view of one electrode). For brevity's sake, assume that the thermal conductance to one electrode and the fluid drag due to one electrode are equal for positive electrode and negative electrode respectively and are ½ of the entire thermal conductance and the entire fluid drag, respectively (actually, the position of nucleating volume is not at the center of the negative electrode and the positive electrode, but is closer to the negative electrode due to the electro-flame-wind. Accordingly, the thermal conductance to the negative electrode is greater than that to the positive electrode). As shown in FIG. 4, (*b*), the fluid velocity $u = 0$ is given, due to the bonding force between the molecule and the solid surface in $y = 0$ (electrode surface). Hence, heat flow to one electrode face, namely, heat flux density $q(x)$, per unit area and per unit time, is proportional to the temperature gradient $(\delta T/\delta y)_{y=0}$ on the electrode surface. Assume that $\mu$ is the thermal conductivity of the flame nucleus, then the heat flux density $q(x)$ is given by $$q(x) = -k\left(\frac{\delta T}{\delta y}\right)_{y=0} \tag{47}$$

and $(\delta T/\delta y)_{y=0}$ is approximated as follows:

$$\left(\frac{\delta T}{\delta y}\right)_{y=0} \approx \frac{T - To}{\delta_T(x)} \tag{48}$$

wherein T is temperature of the flame nucleus gas in the offing of the electrodes, $T_o$ is electrode temperature, and $\delta_T(x)$ is the thickness of a thermal boundary layer (region in which a temperature gradient exists) as shown in FIG. 4 (*a*). The $\delta_T(x)$ is given by the following equation, wherein in the laminar flow, the temperature conductivity of the fluid is *x*, the fluid velocity at the offing being *u*

$$\delta_T(x) \approx \sqrt{\frac{xx}{u}} \tag{49}$$

Accordingly, from the equations (47), (48) and (49), the total heat flow Q which flows, per unit time, to the symmetrically opposed electrodes with flat plane of width w = 1, and length $x = l$ is given, by the following equation:

$$Q = 2\int_o^l q(x)dx \approx -2k(T - To)\int_o^l \frac{1}{\delta_T(x)}dx \tag{50}$$

On the other hand, the friction drag per unit area $\sigma(x)$ of one electrode is the flow of momentum per unit area and per unit time, and therefore is proportional to the velocity gradient $(\delta u/\delta y)_{y=0}$ on the electrode surface. The frictional drag $\sigma(x)$ is given by the following equation, wherein $\eta$ is the viscosity:

$$\sigma(x) = \eta\left(\frac{\delta u}{\delta y}\right)_{y=0} \tag{51}$$

The $(\delta u/\delta y)_{y=0}$ is approximated as follows:

$$\left(\frac{\delta u}{\delta y}\right)_{y=o} \approx \frac{u}{\delta_v(x)} \tag{52}$$

The $\delta_v(x)$ is the thickness of hydrodynamic boundary layer (region in which velocity gradient exists) as shown in FIG. 4, (*b*) and is given by:

$$\delta_v(x) \approx \sqrt{\frac{vx}{u}} \tag{53}$$

Accordingly, from the equations (51), (52) and (53), the friction drag $\Sigma_f$ which works upon the opposed electrodes with flat plane of width $w = 1$, length $x = l$ is given by the following equation:

$$\Sigma_f = 2\int_o^l \sigma(x)dx \approx -2\eta u\int_o^l \frac{1}{\delta_v(x)}dx \tag{54}$$

From the equations (49) and (53), the following equation is given:

$$\delta_T(x) \approx \sqrt{\frac{x}{\nu}}\,\delta_v(x) = \frac{1}{\sqrt{Pr}}\,\delta_v(x) \tag{55}$$

wherein Pr is the Prandtl number. Accordingly, from the equations (50), (54) and (55), the following equation is given:

$$Q \approx \frac{k}{\eta} \sqrt{Pr} \cdot \frac{(T - To)}{u} \Sigma_f \quad (56).$$

On the other hand, the thermal conductance G is defined by $$Q = G(T - T_o) \quad (57).$$

From the equations (56) and (57), the relationship between the thermal conductance G and the friction drag $\Sigma_f$ is given by:

$$q \approx \frac{k\sqrt{Pr}}{\eta u} \Sigma_f \quad (58).$$

Even when the electro-flame-wind on the flat plane electrode is originally turbulent flow, the following relation is given between the q(x) and $\sigma$(x) due to Reynolds analogy, $$q(x) \approx \frac{Cp(\overline{T} - To)}{\bar{u}} \sigma(x) \quad (59),$$

wherein T and u are the average temperature and average speed of the turbulent flow, respectively, and Cp is specific heat at constant pressure. Therefore, even in the turbulent flow as in the laminar flow, the relationship between the thermal conductance G and the friction drag $\Sigma_f$ is given by $$G \approx \frac{Cp}{\bar{u}} \Sigma_f \quad (60)$$

Independently of the laminar flow or the turbulent flow, the thermal conductance G is proportional to the friction drag $\Sigma_f$ of the electrodes, when the flow velocities u & u are under a given constant condition and the fluid drag consists only of the friction drag. By substituting the eq. (53) into the eq. (54) and effecting the integration, the following equation is given:

$$\Sigma_f \approx -\frac{4\eta u^{\frac{3}{2}} l^{\frac{1}{2}}}{\nu^{\frac{1}{2}}} \quad (61).$$

It is found out from the above equation that, in the electrodes with flat discharging plane, as the length $l$ decreases, the friction drag $\Sigma_f$ with respect to the flow of the flame nucleus gas decreases in proportion to $\sqrt{l}$. As a result, the thermal conductance G is in proportion to $\sqrt{l}$ and thus the condition of the ignition is improved as can be understood from the inequality (1). Generally speaking, in the electrode with flat discharging plane, $\Sigma_f$ and G decrease as dimensions, which govern the fluid resistance with respect to the flow of the flame nucleus gas, decrease, and therefore, the condition of the ignition is improved, thus allowing the lean gas mixture to be ignited and burned effectively. It is too complex precisely and perfectly to indicate the abovementioned "dimensions". But, for the electrode arrangement that end face is the discharging face, the "dimensions" can be indicated or represented by diameter for circular cylinder, by length of diagonal for square section cylinder or by length of the longest diagonal for polygonal section cylinder.

The above description is given only about the frictional drag $\Sigma_f$ in the fluid drag $\Sigma$ of the electrodes. In the case of the electrode having flat discharging plane with edges on the ends of discharge plane of the electrode, the separation of the boundary layer occurs at the edges. Thus, wakes of the turbulent flow type are likely to be caused around the separated boundary layer. Viscosity, diffusion and thermal conduction are phenomena wherein momentum, constituent molecules and kinetic energy are transported by molecular motion, respectively, but the turbulence transport, the momentum, the constituent molecules and the kinetic energy is extremely large scale (eddy transport). Accordingly, in the turbulence, apparent coefficient of viscosity, apparent diffusion coefficient and apparent thermal conductivity which are called as eddy viscosity, eddy mass diffusivity and eddy thermal diffusivity, respectively, become extremely large in value. Thus, when the turbulent flow is caused, the pressure drag $\Sigma_p$ is produced and is added to the friction drag $\Sigma_f$. Therefore, the total fluid drag $\Sigma = \Sigma_f + \Sigma_p$ increases, thus resulting in remarkable increase of the thermal conductance G, which remarkably deteriorates the condition of the ignition.

On the other hand, even in a thick electrode, if the discharging plane is made convex (streamline shape, without discontinuous edge such boundary layer separation as described hereinabove, namely, the turbulent flow occurrence can be prevented. Since the pressure drag $\Sigma_p$ is hardly caused, the total fluid drag $\Sigma$ decreases by the amount of $\Sigma_p(\Sigma = \Sigma_p + \Sigma_f \approx \Sigma_f)$, thereby effectively decreasing the thermal conductance G. As the thermal conductance G becomes also small, effectively, the condition of the ignition is improved remarkably. If the electrode is made streamline and thin in shape, the $\Sigma_f$ is further decreased, thus resulting in further improving igniting conditions.

(c) Reasons why the conventional spark-plug can not ignite lean gas mixture.

Figure 5A:
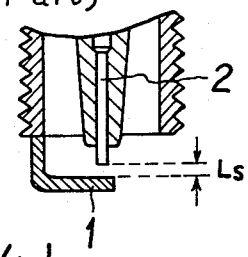
FIG.5(a). (Prior art)
FIG. 5 and FIG. 6 together show one example of the conventional thin electrode type spark-plugs, the respective (a)s and (b)s of FIG. 5 and FIG. 6 showing the sectional side views and the bottom views, FIG. 6(*c*) showing the sectional front view.
Figure 5B:
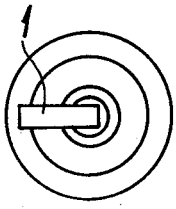
Figure 41:
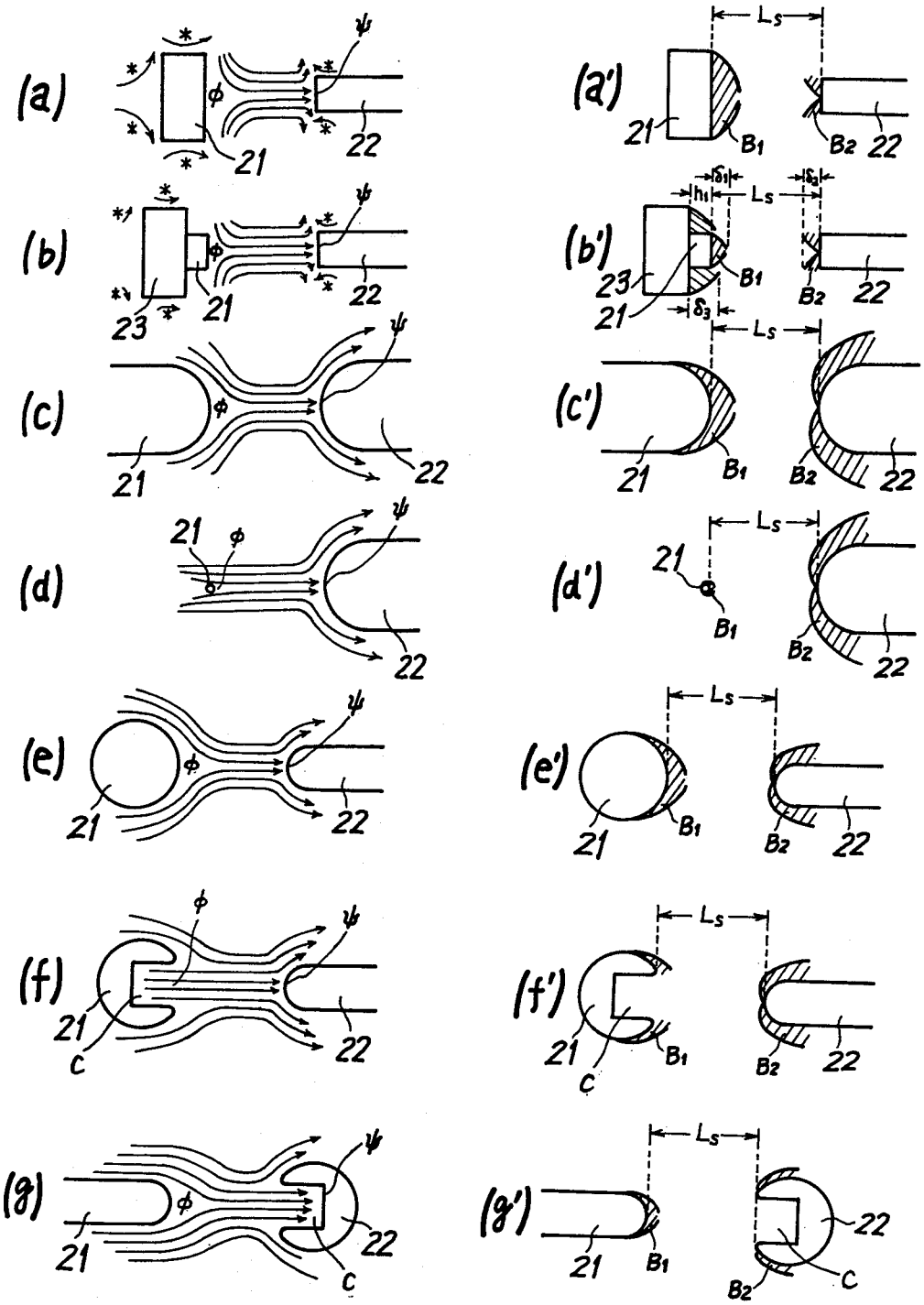
FIG. 41, (a) and (a') show the streamlines (in section) of the electro-flame-wind in the conventional thin electrode type spark-plug, and the structure (in section) of the boundary layers with respect to the electro-flame-wind, respectively, the (b) to (g) thereof showing the streamlines (in section) of the electro-flame-wind in the various spark-plugs of the present invention, the (b') to (g') thereof showing the constructions (in section) of the boundary layers with respect to the electro-flame-winds corresponding to the (b) to (g), respectively, any of electrode gaps in these spark-plugs being the same value $L_s$.
Figure 42:
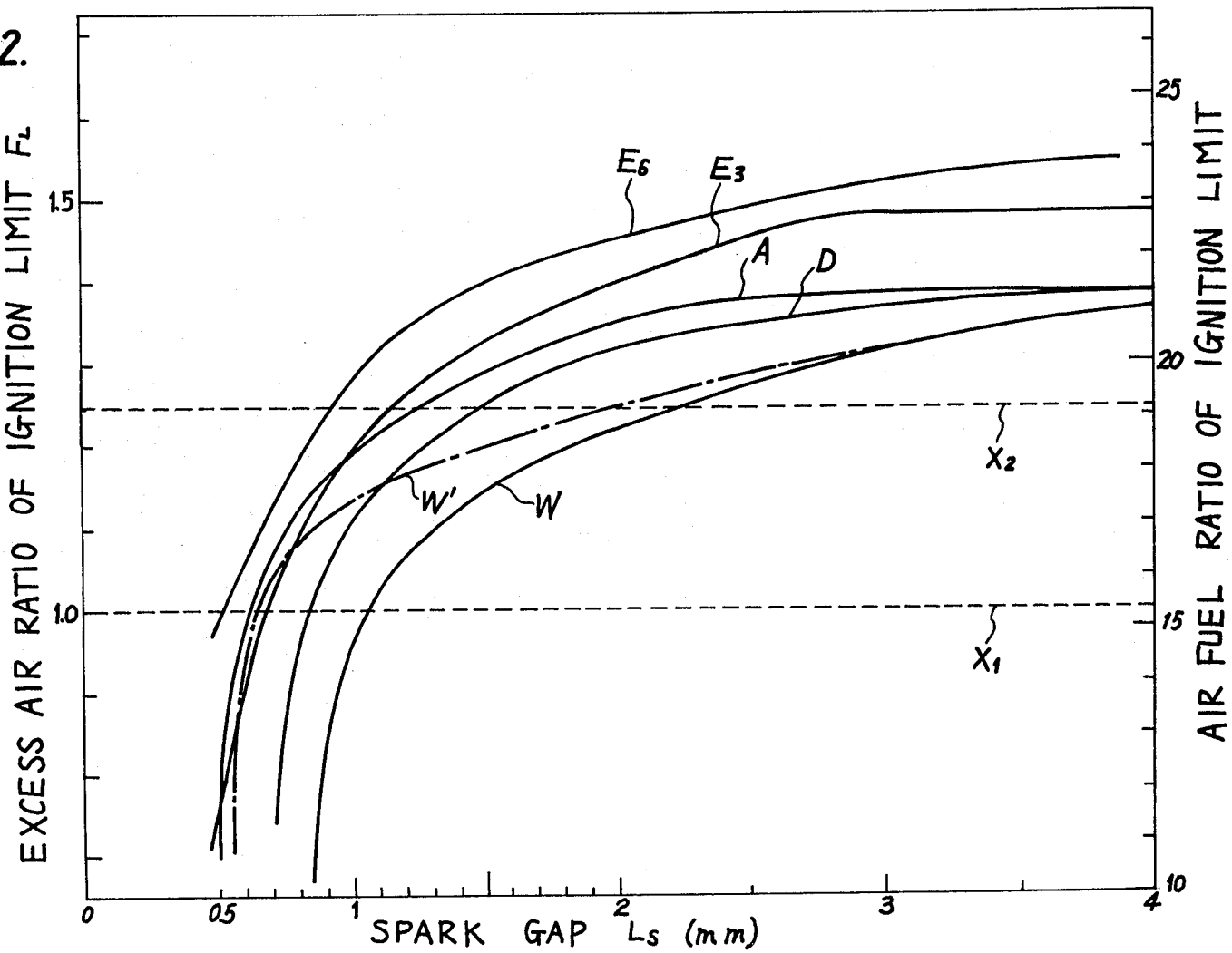
FIG. 42 to FIG. 45 show the experimentally measured characteristics of the ignition limit excess air ratio $F_L$ of the spark-plugs (ordinate on the left side) and the electrode gap distance $L_s$ (abscissa); in any graphs, the ordinate on the right side showing the ignition limit air fuel ratio, a horizontal dotted line $X_1$ showing an equivalent air fuel ratio (F = 1), curves W, W' and $E_O$ showing the $F_L$-$L_S$ characteristic curves of the conventional spark-plugs, the other curves A, D, $E_1$ to $E_6$, $G_2$, $G_3$, $K_1$, $N_1$, $N_3$, $N_4$, $N_6$ and $N_7$ showing the $F_L$-$L_S$ characteristic curves of the spark-plugs of this invention, $X_2$ showing each level of the air fuel ratio = 19.25, (F = 1.25), the region below the each curve being the ignitable region.

The streamline of the electro-flame-wind in the conventional type of spark-plug as shown in FIG. 5 is shown in section, in FIG. 41, (a) and the structure of the boundary layers accompanied in this flow is shown in section, in FIG. 41, (a'). The boundary layer is supposed to be in such a shape, as in $B_1$, in the front face of the positive electrode 21 and in such a shape, as in $B_2$, in the front face of the negative electrode 22, in accordance with the equations (49) or (53). As apparent from the above description, the friction drag $\Sigma_f$ increases when the streamline passes through the boundary layer. As a wide plate, namely, of large in dimensions $l$, is used for the positive electrode 21, the boundary layer $B_1$ is thick and the $\Sigma_f$ is large. Besides, the streamline with a mark * in FIG. 41, (a) shows the wake of turbulent flow type. The turbulent flow caused on the side face and the rear side of the positive electrode 21 is large on scale and the pressure drag $\Sigma_p$ also increases remarkably. As a result, the fluid drag $\Sigma = \Sigma_f + \Sigma_p$, hence, the thermal conductance G from the flame nucleus to the electrode is large, and the establishment of the ignition limit conditional inequality (1) becomes hard. Thus, such a conventional type of spark-plug as shown in FIG. 5 can not sufficiently ignite the lean gas mixture as apparent from the curve W of FIG. 42 showing the ignition limit excess air ratio $F_L$ and electrode gap distance $L_s$ characteristics.

Figure 6A:
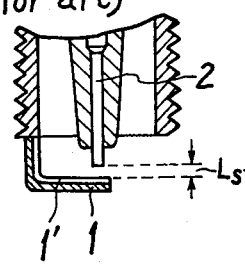
FIG.6(a). (Prior art)
Figure 6C:
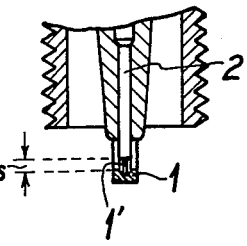
Figure 6B:
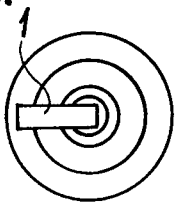

On the other hand, as shown in FIG. 6, the $F_L$ - $L_s$ characteristic curve W' of the conventional type of spark plug lies on the left hand of the curve W, thus resulting in some improvements. However, W' does not go upwardly, being different in quality from the behaviour of FIG. 3, wherein the ignition limit characteristic curves displace leftwardly and simultaneously upwardly when G is made small as shown in FIG. 3. This fact will be described hereinafter. Namely, the spark-plug of the curves W' is provided with uneven grounded-electrode having U-shaped groove on a rectangular parallelepiped plate hence having many edges as shown in FIG. 6. Accordingly, these edges are likely to separate the boundary layer to cause the turbulent flow, and therefore the percentage of the pressure drag $\Sigma_p$ in the fluid drag $\Sigma$ is large. The pressure drag $\Sigma_p$ is given by the following equation, wherein $\rho$ is fluid density, $u$ is flow velocity, $l$ is the "dimensions" of the object and $\kappa$ is a factor related to the shape of the object:

$$\Sigma_p = \kappa \rho u^2 l^2 \quad (62).$$

As described hereinbefore the pressure drag $\Sigma_p$ increases in proportion to the square of the flow velocity $u$ (Newton's law of resistance).

Next, the dependency on spark gap $L_s$ of the electro-flame-wind velocity u will be described. Discharge current $i_s$ shows exponential decay concerning time t as follows: is $i_s = i_o \exp(-t/\tau)$, ($i_o$: discharge current in $t=0$, $\tau$: decay time constant for discharge). $\tau = 2.27$ ms for $L_s=0.84$ mm, and $\tau=1.93$ ms for $L_s=1.56$ mm have been obtained from the oscillogram analysis of the $i_s$ under a given condition of discharge energy. Namely, as the electrode gap distance $L_s$ is made larger, the discharging ceases in a shorter time, and thus the energy consumption rate (speed) increases. Since one portion of the discharge energy is converted, into the kinetic energy of the electro-flame-wind, which is greatly subject to the influences from the cation drag, an increase in the energy consumption rate causes the increase in the electro-flame-wind velocity u. Accordingly, an increase of the electrode gap distance $L_s$ causes an increase of the electric flame fluid velocity $u$, and therefore in accordance with the eq. (62) the pressure drag $\Sigma_p$, hence, the thermal conductance G increases. In the conventional type of spark-plug as shown in FIG. 6, the characteristic curves of the excess air ratio $F_L$ of lean mixture side ignition limit vs. electrode gap distance $L_s$ of FIG. 3 are plotted for various G as parameter. Therefore, as $L_s$ increases, the operation point moves from curve to curve as $d \rightarrow c \rightarrow b \rightarrow a$ in FIG. 3. As a result, the upward movement of the $F_L - L_s$ characteristic curves is prevented remarkably. Accordingly, the characteristic shown in the curve W' of FIG. 42 are provided, thus making easy ignition of the lean gas mixture hard. The result of the abovementioned theoretical analysis is as follows. When the electrodes of the spark-plug has the form, size and arrangement for decreasing the fluid resistance against the electro-flame-wind contained inside the nucleating volume, then the thermal conductance G can be made small, thus increasing the excess air ratio $F_L$ of the lean mixture ignition limit in accordance with the relationship of the inequality (1). In the conventional spark-plug, the fluid resistance of the electrode with respect to the electro-flame-wind has not been taken into consideration and the thermal conductance G has been large, and hence the spark-plug itself has had a flame-arrestive characteristic so that the flame nucleus once made has been liable for the annihilation.

From the theoretical analysis of the above description, the requirements on the form, size and arrangement of the electrodes which allow the spark-plug to ignite the lean gas mixture are found as follows:

(1) The positive and negative electrodes shall be thin and be disposed in coaxial relation so that the axes of both electrodes may be aligned in line with each other.

For the electrodes of the present invention, thin electrodes, for instance, rod-shaped or cylindrical electrodes can be used as elucidated hereinafter referring to the examples. Hereinafter, the word "rod" is used to imply a cylinder or analogous one which includes any types of cylinder, for instance, circular cylinder, square section cylinder (square prism), polygonal section cylinder, etc. or slightly tapered cylinders wherein one bottom is slightly larger than the other.

(2) At least one of the electrodes shall have discharging face made convex surface (in streamline shape) and be disposed in coaxial.

(B) EMBODIMENT:

First, the condition for experiments to obtain the excess air ratio $F_c$ of ignition limit (especially, to obtain the excess air ratio $F_L$ of the ignition limit for the lean mixture side) in each embodiment of the present invention will be described.

In order to precisely obtain the excess air ratio $F_L$ of ignition limit (degree of leanness of fuel), isobutane of 100% in degree of vaporization was used. The isobutane is a component of liquefied petroleum gas (LPG) having the ignition temperature 673° K which is above the ignition temperature about 523° K for gasoline. Accordingly, the isobutane is usable as sample fuel in this experiment.

For power supply, an apparatus which generates peak voltage of 35KV at no-load by operating an ignition coil (rating: primary coil for 12 V, 4.1A, inductance of 8.58 mH, stored energy 72 mJ) by means of a transistor switch was used. The power supply was connected to the spark-plug from the positive terminal to the grounded electrode (a first electrode) of the spark-plug and from the negative terminal to the high-tension electrode (a second electrode).

It is desirable that electrode gap distance is 0.8 mm or less when the ordinary ignition power supply of the internal combustion engine is used. From measurements and calculations, the "dimensions" of the electrodes of the spark-plug, which allows the characteristic curves of the excess air ratio of ignition limit $F_L$ vs. the spark gap $L_s$ to cross an equivalent air fuel ratio straight line $X_1$ when $L_s=0.8$mm, are obtained as described hereinafter. Namely, for the electrode of which front end is a discharging face, 1.7 mm of diameter when the cross-sectional view of the electrode was circular, and 1.7mm of diagonal line when the cross-sectional view thereof is rectangular are to be used as the dimensions. For the electrode, of which side face is the discharging face, 1.2mm width and 2mm of thickness are to be used as the dimensions. The width used here is the size of the electrode face measured in the direction having right angle to the discharging direction and in the widthwise direction of the electrode, while the thickness used here is the size of the rod-shaped electrode along the discharging direction.

Therefore, according to the present invention, in a rod-shaped electrode, in which the front end is of discharging face, the diameter should be 1.7mm or less if the cross-sectional plane of the electrode is circular, and the diagonal line should be 1.7mm or less if the cross-sectional plane thereof is rectangular. In the rod-shaped electrode, in which a side face is of discharging plane, the width should be 1.2mm or less, and the thickness should be 2mm or less.

The automobile internal combustion engines of lean gas mixture combustion type according to this invention comprise a combustion chamber, a lean gas mixture producing device for producing the lean gas mixture having $F \geqq 1$ in operation modes including idling, engine-braking, constant speed, acceleration and deceleration, a compressing means for compressing lean gas mixture containing air and fuel by varying volume of the combustion chamber and at least one electric spark-plug for igniting the compressed lean gas mixture.

The abovementioned spark-plug can be constructed as described in the following.

The following examples 1 to 4 relate to spark-plugs comprising a pair of rod-shaped electrodes each with flat discharging face, for first and second electrodes.

EXAMPLE 1 (FIG. 7)

Figure 7A:
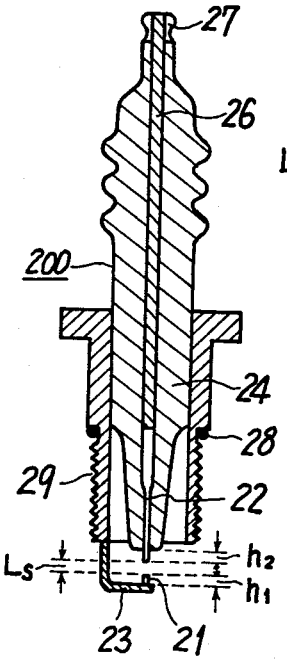
FIG. 7 shows one embodiment of the two-electrode spark-plug of the present invention, the (a) of FIG. 7 being the sectional side view of the two-electrode spark-plug, the (b) thereof being the sectional side view of essential parts, the (c) thereof being the bottom view.
Figure 7B:
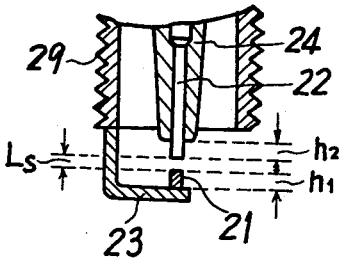
Figure 7C:
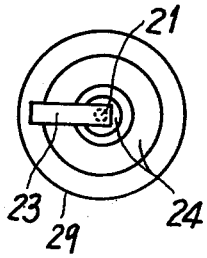

As shown in FIG. 7, (*a*), (*b*), (*c*) and Table 3, the spark-plug 200 of the present invention comprises a metallic screw part 29 to be engaged with the internal combustion engine, an electrode terminal part 27, an insulator 24 for supporting the above-mentioned screw part and the electrode terminal part in given relative positions, keeping them insulated from each other, and a pair of electrodes, namely a first electrode 21 and a second electrode 22. The first electrode is installed on a supporter 23 which is mounted on the metal screw part 29. The second electrode 22 is a rod-shaped member, which is electrically-connected to the electrode terminal part 27 by means of a central conductor 26, and is arranged in parallel with the central axis of the metallic screw part 29 and is supported by means of the insulator 24, so that a given ignition gap distance is provided between the given part on the first electrode 21 and the rod-shaped member 22. Numeral 28 designate a gasket.

The first electrode 21 is a rod-shaped electrode, which is projected, by a given height $h_1$, e.g. 1mm, from the end of supporter 23 made of heat-resisting nickel alloy, etc., towards the second electrode 22, in the direction of the central axis of the metallic screw part 29, having at its front end, a discharging plane normal to the central axis. The first electrode is installed on the supporter 23 through methods of welding, driving, forced insertion, or caulking after insertion, etc. In order to simplify the machining operation, it is recommended that the first electrode 21 and the supporter 23 should be composed of a continuous member. The above-mentioned structure and machining can be applied even to the spark-plugs of Examples 2 to 17 given hereinafter. The second electrode 22 is a rod-shaped electrode, which is projected, by a given height $h_2$, e.g. 1mm, from the end of insulator 24 and has a discharging plane normal to the central axis. The first and second electrodes 21 and 22 are disposed coaxially with spark gap of, for example, 1.28mm inbetween.

In the present embodiment, when a rod-shaped electrode of from 1.7mm to 0.3mm in diameter and preferably, about 1mm in diameter are used, it is desirable for the sake of durability, to use noble metals, which are superior in heat resisting and electro-corrosion resisting properties, such as Pt, Pd, Au, or alloy thereof.

In the spark-plug in this enbodiment, both electrodes have small diameters, respectively. As shown in FIG. 41, (*b'*), both boundary layers $B_1$ and $B_2$ are thin and the friction drag $\Sigma f$ is small as apparent from the eq. (61). Therefore, from the equations (58) and (60), the thermal conductance G from the flame nucleus to the electrodes becomes small. As a result, the condition of ignition is improved as is indicated by the inequality (1). The $F_L$-$L_s$ characteristic curve A of FIG. 42 (The curve A corresponds to a case where the projection height of grounded electrode $h_1 =$ 1mm and the raised height of high-tension electrode $h_2 =$ 1mm, as shown in the line A of Table 3) of the spark-plug of this embodiment lies remarkably on the left-upward position as compared with the characteristic curves W and W' of the conventional spark-plug.

As described hereinbefore, the condition of ignition is remarkably improved when both electrodes 21 and 22 are projected and raised from the supporter 23 and the insulator 24, respectively. The degree of the improvements depend upon the projection height $h_1$ and/or $h_2$ as described hereinafter.

Figure 46:
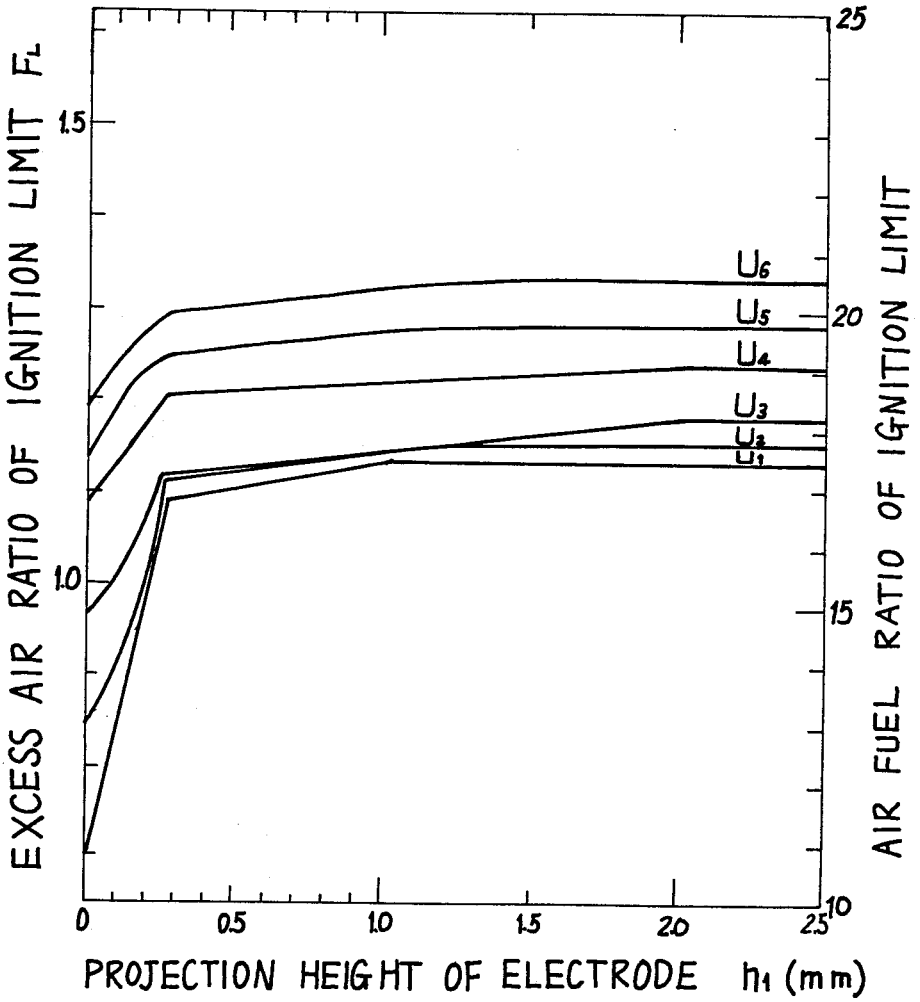
FIG. 46 shows the ignition limit excess air ratio $F_L$ (ordinate on the left side), with the spark gap $L_S$ as a parameter, in the spark-plug shown in FIG. 7, or shows experimentally measured characteristics of dependence of ignition limit air fuel ratio (ordinate on the right side) upon the first electrode projection height $h_1$ (abscissa).

The speed (*u*) of the electro-flame-wind produced in a position in the electrode gap decreases as the position departs farther from the gap. Accordingly, the thickness $\delta 3$ of a boundary layer which is formed on the surface of the supporter 23 is considerably large as compared with the respective thickness $\delta 1$ and $\delta 2$ of boundary layers $B_1$ and $B_2$. The influences of $\delta 3$ at least, on viscosity frictional loss can be neglected under the condition of $h_1 + \delta 1 \geqq \delta 3$. Therefore, only the electrode thickness effect $l$ should be considered. Accordingly, the ignition limit air fuel ratio $F_L$ must be almost saturated for above a given critical projection height $h_1$. Inversely, in the projection height $h_1$ under the condition of $$h_1 + \delta 1 < \delta 3,$$

the effect of the viscosity frictional loss due to the thick boundary layer of $\delta 3$ thickness along the supporter 23 exists, and thus the ignition limit air fuel ratio $F_L$ depends upon the projection height $h_1$. The results of the experiments by which the above description is proved are shown in FIG. 46 and in Table 3, lines $A_1$ to $A_6$. FIG. 46 shows the experimental results measured concerning the relation between the projection height $h_1$ of the first electrode and the ignition limit air fuel ratio $F_L$ of the spark-plug shown in FIG. 7, with the spark gap $L_s$ as a parameter. In the experiments, a metal-plate supporter 2.7mm wide, about 5mm long is used as the supporter 23, while the cylindrical electrodes of 1mm in diameter are used as the first electrode 21 and the second electrode 22, respectively. The raised height $h_2$ of the second electrode is 1mm. Also, in FIG. 46, curve $U_1$ shows the measured results of $L_s =$ 0.85 mm; curve $U_2$, $L_s$=0.9mm; curve $U_3$, $L_s$=1.0mm; curve $U_4$, $L_s$= 1.25mm; curve $U_5$, $L_s$= 1.5mm; and curve $U_6$, $L_s$= 2.0mm, respectively. As apparent from FIG. 46, in each characteristic curve, the ignition limit excess air ratio $F_L$ is almost saturated for the range of $h_1 \geqq$ 0.25mm. Namely, the critical value of $h_1$ is $h_1$=0.25mm. Thus, it is desirable for the projection height $h_1$ to be larger than 0.25mm to ignite the lean mixture. Since the end of the supporter 23 (FIG. 41 (*b'*)) is retreated from the electrode gap by $h_1$, the turbulent flow is difficult to be produced on the side face and the rear side. Accordingly, the pressure drag $\Sigma p$, hence thermal conductance G decreases further and the curve A of FIG. 42 goes further leftwards and upwards with respect to the curves W and W' of FIG. 42. Accordingly, the leaner gas mixture can be ignited.

The effect of projection of the first electrode 21 from the supporter 23 as described hereinbefore is similarly realized, if the second electrode 22 is raised from the end of insulator 24.

Examples 2 to 17 which will be described hereinafter relate to spark-plug, with first electrode 21 and the second electrode 22 both raised from the supporter 23 and the insulator 24 by 0.25mm or more, respectively. Accordingly, in the examples 2 to 17, given hereinafter, the forms, sizes and arrangements of the electrodes only and effects thereof will be described, omitting descriptions on common items.

Referring to the drawings of the spark-plug in all examples, the same reference marks and numerals as those for Example 1 will be given to all the corresponding components.

EXAMPLE 2 (FIG. 8)

Figure 8A:
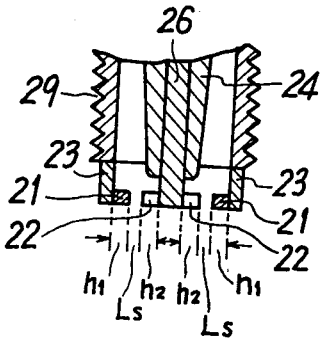
Figure 8B:
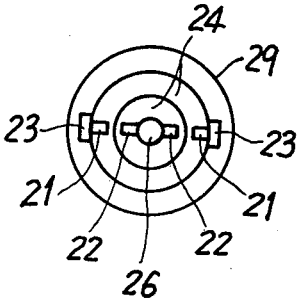

The spark-plug in this embodiment shown in FIG. 8, (*a*) and (*b*) has two pairs of electrodes. A pair of first electrodes 21, and 21 are rod-shaped electrodes, which are projected from the supporters 23 and 23 by a given height $h_1$, respectively, towards a second electrodes 22 and 22, in the direction normal to the central axis of the metallic screw part 29. The electrodes have in their front end, discharging faces in parallel with the axis, respectively. The second electrodes 22 and 22 are rod-shaped electrodes, which are raised by a given height $h_2$, from the central axis 26 in the direction vertical to the axis and have a discharging planes in parallel to the axis, respectively. The first electrodes 21 and 21 and the second electrodes 22 and 22 are disposed to allow their discharging planes to face each other, respectively, with the electrode gap distance $L_s$ between each pair of the electrodes 21 and 22. By providing two pairs of electrodes, the spark-plug of this embodiment has an advantage, in terms of durability (service life), of having longer life than the spark-plug of FIG. 7 (Example 1). It is also recommendable that three pairs of electrodes or more should be provided to obtain further increased service life.

EXAMPLE 3 (FIG. 9)

In the spark-plug of this embodiment shown in FIG. 9, a first electrode 21 is a rod-shaped electrode, which is projected by a given height from a supporter 23 towards below the second electrode 22 in the direction vertical to the central axis of the metallic screw part 29, and has discharging face on its upper side face, while the second electrode 22 is a rod-shaped electrode, which is raised, by a given height, from an insulator 24, and has, at its front end, a discharging face normal to the axis. The lengthwise axis of the first and the second rod-shaped electrodes 21 and 22 are disposed at right angle with each other. As apparent from the value in line B, column $L_s$* of Table 3, the effects similar to those of Example 1 are obtained by this spark-plug,

EXAMPLE 4 (FIG. 10)

Figure 10A:
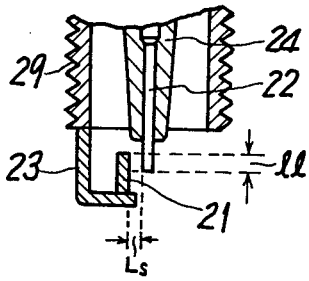
Figure 10B:
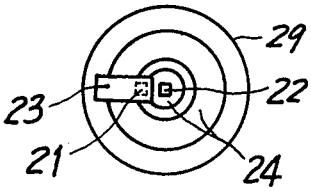

As shown in FIG. 10 and Table 3, C line, in the spark-plug of this embodiment, a first electrode 21 is a rod-shaped electrode, which is projected, by a given height, from a supporter 23, towards a second electrode 22, in the direction parallel to the central axis of the metallic screw part 29, and has on its side face, a discharging plane which is parallel to the axis, while the second electrode 22 is a rod-shaped electrode, which is projected, by a given height, from an insulator 24 and has, on its side face, a discharging plane parallel to the axis. The first and second rod-shaped electrodes 21 and 22 are disposed in parallel to each other with their discharging faces of respective given lengths *ll* (for example 1mm) opposing to each other. The opposing lengths *ll* of both electrodes are determined through consideration of electro-corrosion-resisting property, namely, service life. As apparent from the value of Table 3, line C, column $L_s$*, the effects similar to those of the Example 1 are obtainable also by this example. In this spark-plug, area of discharging face increases in proportion to the opposing lengths *ll* of both electrodes. Accordingly, the spark-plug in this Example 4 is superior, in electro-corrosion resistivity.

In the rectangular type spark-plug of the Example 3 (FIG. 9), one of the electrodes, or a first electrode is shaped so as to have its axis having right angle with sparking lines. Accordingly, the boundary layer $B_1$ shown in FIG. 41, (*b'*), spreads, also to the axial direction of the electrode. Also, in the spark-plug of Example 4 (FIG. 10), both electrode have their axis at right angles with the sparking lines, and thus the boundary layers $B_1$ and $B_2$ spread also in the axial direction of the electrode. Therefore, the friction drag $\Sigma f$ increases.

Accordingly, from the equations (61), (58), and inequality (1) and from the experimental results, it is generally obvious that establishment of the ignition condition is more advantageous for the right-angle-arranged rod electrodes type than that of a parallel rod electrodes type, and further advantageous for coaxial-arranged rod electrodes type. The effect of this electrodes arrangements are also obtainable in the following examples 5 to 17.

Table 3

(Examples 1, 3 and 4)

| Marks of $F_L$-$L_s$ Characteristic Curves | Types of Electrodes | Electrodes Arrangement | Dimensions (mm) of Grounded Electrode (First Electrode 21) | Dimensions (mm) of High-Tension Electrode (Second Electrode 22) | $L_s$* (mm) |
|---|---|---|---|---|---|
| A | Fig. 7 | coaxial | 1.0 diameter 1.0 $h_1$ | 1.0 diameter 1.0 $h_2$ | 1.28 |
| ($A_1$) | Fig. 7 | — | 2.7 width 1.3 thickness 5 length 0 $h_1$ | 1.0 diameter 1.0 $h_2$ | 2.28 |
| ($A_2$) | Fig. 7 | Coaxial | 1.0 diameter 0.07 $h_1$ | 1.0 diameter 1.0 $h_2$ | 2.06 |
| ($A_3$) | Fig. 7 | coaxial | 1.0 diameter 0.14 $h_1$ | 1.0 diameter 1.0 $h_2$ | 1.81 |
| ($A_4$) | Fig. 7 | coaxial | 1.0 diameter 0.25 $h_1$ | 1.0 diameter 1.0 $h_2$ | 1.59 |

Table 3-continued (Examples 1, 3 and 4)

Figure 9A:
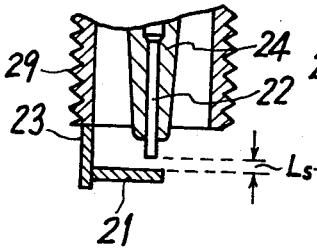
Figure 9C:
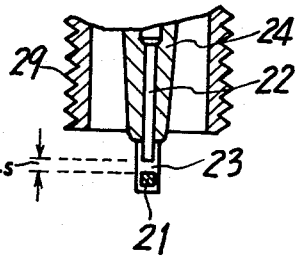
Figure 9B:
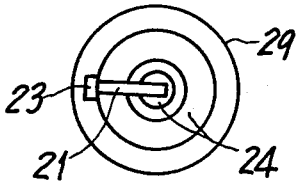

| Marks of $F_L$-$L_s$ Characteristic Curves | Types of Electrodes | Electrodes Arrangement | Dimensions (mm) of Grounded Electrode (First Electrode 21) | Dimensions (mm) of High-Tension Electrode (Second Electrode 22) | $L_s$* (mm) |
|---|---|---|---|---|---|
| ($A_5$) | Fig. 7 | coaxial | 1.0 diameter 0.5 $h_1$ | 1.0 diameter 1.0 $h_2$ | 1.45 |
| ($A_6$) | Fig. 7 | coaxial | 1.0 diameter 2.0 $h_1$ | 1.0 diameter 1.0 $h_2$ | 1.28 |
| ($B_5$) | Fig. 9 | with right angle | 1.0 width 0.62 thickness 5 length | 1.0 diameter | 1.52 |
| (C) | Fig. 10 | parallel (with opposing lengths ll = 1.0mm) | 1.0 width 0.62 thickness 5 length | 1.0 width 1.0 thickness 5 length | 1.52 |

Note: Curves for ($A_1$) to ($A_6$), ($B_5$) and (C) are almost analogous to that of A, and therefore, are not shown in the graphs.

The belowmentioned examples 5 to 11 relate to spark-plugs each comprising the first and second electrodes, at least one of which has convex discharging face.

EXAMPLE 5 (FIGS. 11 to 13 and 15)

Figure 11A:
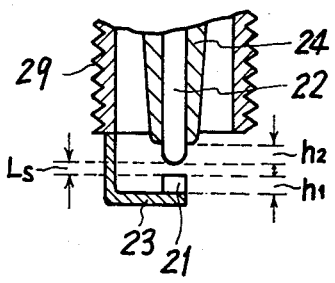
Figure 11B:
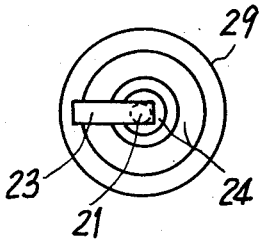

As shown in FIG. 11, in the spark-plug of this embodiment, a first electrode 21 is an electrode, which is projected by a given height $h_1$ towards below a second electrode 22 in the axial direction, and has at its front end a flat discharging face with right angle with the axis, while a second electrode 22 is an electrode, which is projected, by a given height $h_2$ from an insulator 24 and has at its front end a convex discharging face. And the first and second electrodes 21 and 22 are disposed coaxially with each other.

Figure 12A:
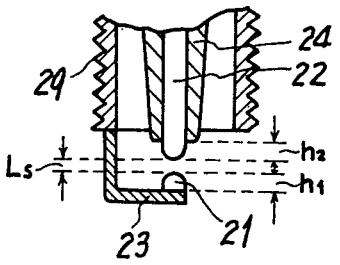
Figure 12B:
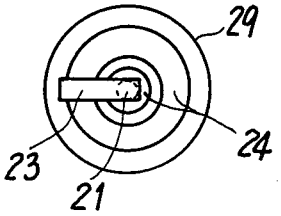
Figure 13A:
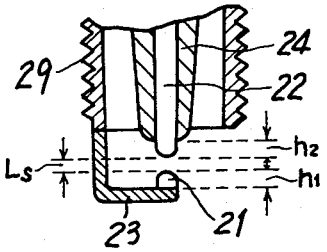
Figure 13C:
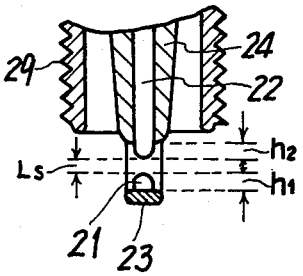
Figure 13B:
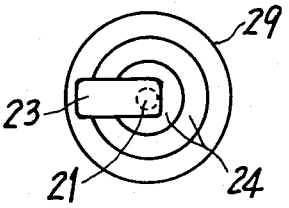

In order to provide further improved ignition characteristics, it is recommended that both electrodes should have convex discharging faces at respective front end as shown in FIG. 12, and FIG. 13.

Figure 43:
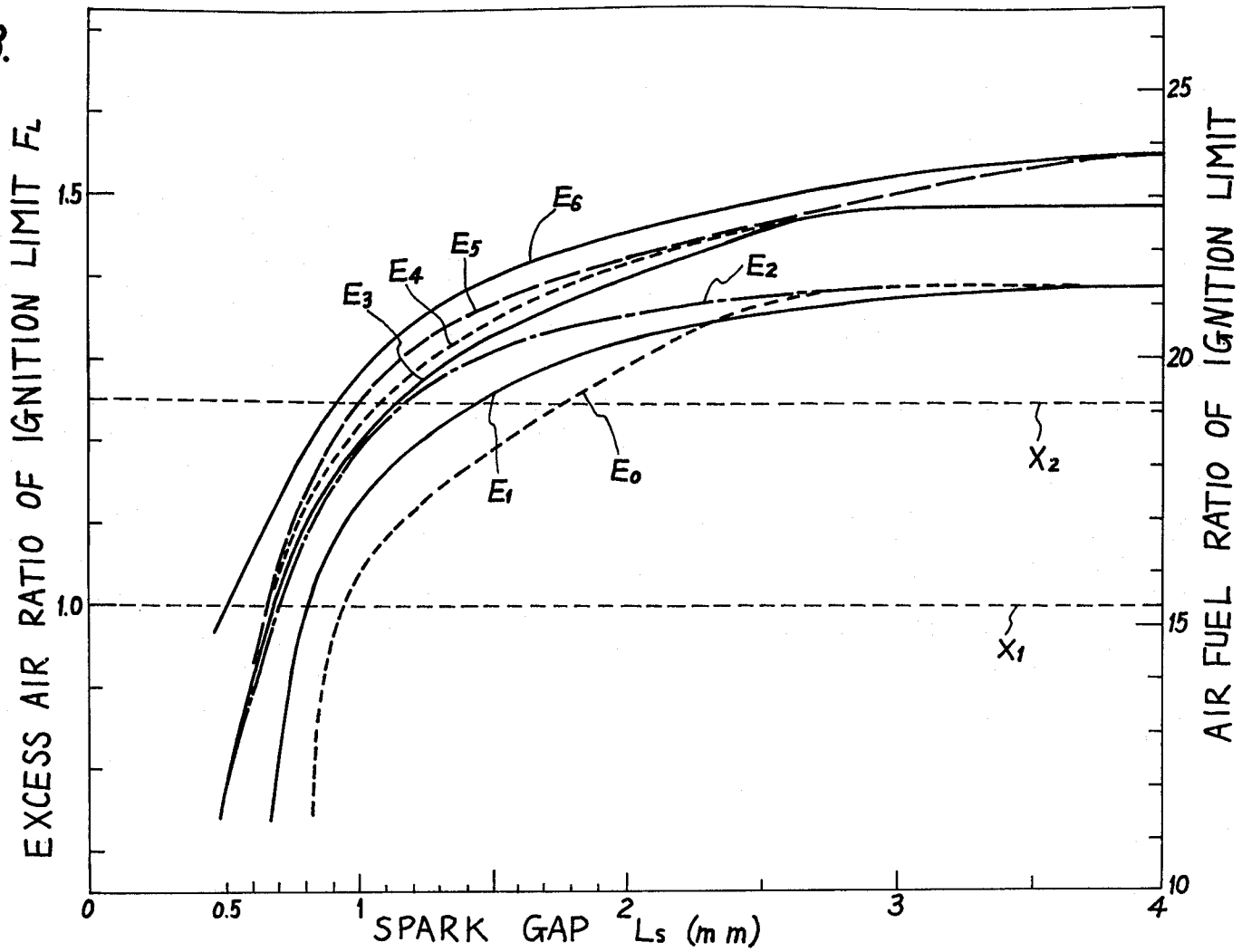

As shown in FIG. 41, (*c*) and (*C'*), the boundary layers $B_1$ and $B_2$ concerning the electro-flame-wind on the electrodes of the spark-plug of, for instance, FIG. 12 are both retreated with respect to and from the flame nucleus space, the dimensions *l* effectively become small and friction drag $\Sigma f$ decreases. Simultaneously, both electrodes are streamlined, thus resulting in smaller occurrence of the turbulent flow, and the pressure drag $\Sigma p$ is extremely reduced. Accordingly, the fluid drag $\Sigma = \Sigma f + \Sigma p$ and the thermal conductance G become small, and the $F_L - L_s$ characteristic curve considerably moves leftward and upward with respect to the curve W as shown in FIG. 42, curves $E_3$ and $E_6$. Therefore, sufficiently lean gas mixture can be ignited. The abovementioned effect of retreating the boundary layer increases as the curvature v of the discharging plane increases. The above conclusion is apparent from the $F_L$-$L_S$ characteristic curves $E_0$ to $E_3$ of FIG. 43 and FIG. 47, which indicates that in the practical range of an electrode gap Ls of less than 2mm, the excess air ratio of ignition limit rapidly increases with the curvature V and saturates in the region around the numerical value 0.46mm$^{-1}$ of curvature. (curves $E_0$ to $E_3$ are for the cases of various curvatures $E_0$ to $E_3$ shown by FIG. 15 and in Table 4 lines $E_0$ to $E_3$, column C). FIG. 43 shows measured characteristic curves indicating the relationship between the ignition limit excess air ratio $F_L$ and the electrode gas distance $L_S$, in a case where the electrodes have diameters fixed at 2.55 mm, and the curvature V only on the discharging face of the electrode front end is changed variably as shown in Table 4.

Figure 15:
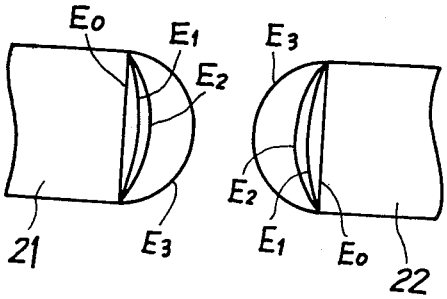
FIG. 15 is a side enlarged view of the electrode discharging faces of the spark-plug, the $E_O$ of FIG. 15 showing the conventional spark-plug electrodes, the $E_1$, $E_2$ and $E_3$ showing the spark-plug electrodes of the present invention.
Figure 47:
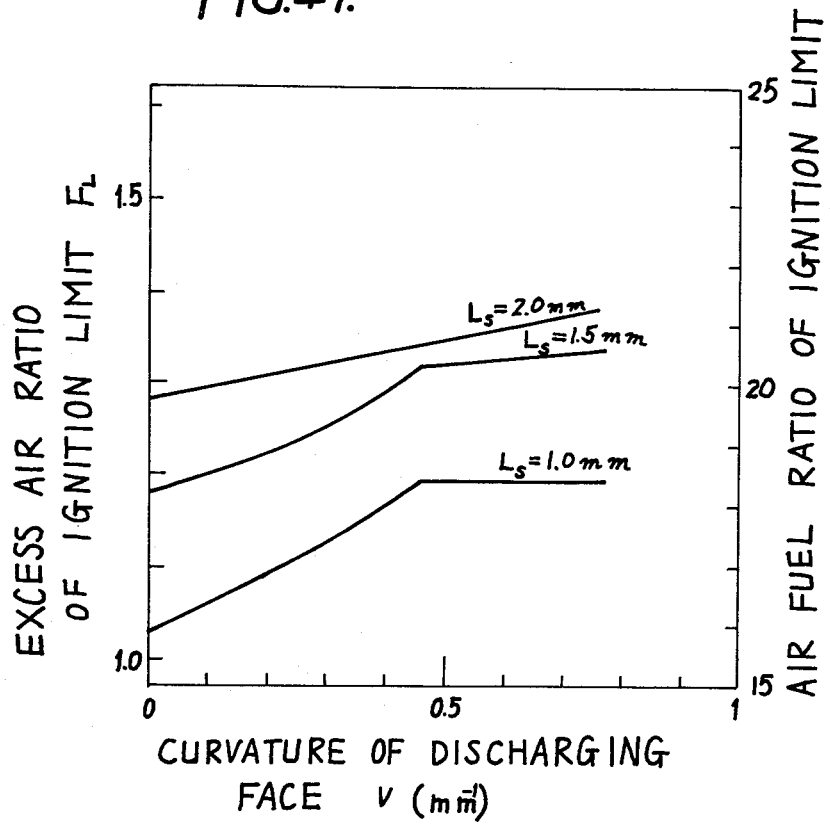
FIG. 47 shows the ignition limit excess air ratio (ordinate on the left side), with the spark gap $L_s$ as a parameter in the spark-plug shown in FIG. 12, or shows experimentally measured characteristics of dependence of ignition limit air fuel ratio (ordinate on the right side) upon the curvature v (abscissa) of the electrode discharging face.

FIG. 47 shows measured characteristic curves of dependence the excess air ratio $F_L$ of ignition limit upon the curvature V of the electrode discharging face with the electrode gap distance $L_S$ for the curves $E_0$ to $E_3$ of FIG. 43 as a parameter. In FIG. 43, only the curve $E_3$ lies above the curves $E_0$, $E_1$ and $E_2$. In the electrode of the curve $E_3$, the front end discharging face is of a hemispherical type and connects with cylindrical side face smoothly without edge, accordingly no turbulent flow is produced. On the other hand, as shown in FIG. 15, in the electrodes of the curves $E_0$, $E_1$ and $E_2$, the convex discharging faces and the electrode side faces make edges inbetween, so that a turbulent flow are caused.

Needless to say, it is understood from FIG. 42, curve D, that the ignition characteristic of the aforementioned spark-plug of a type shown in FIG. 11 and in Table 4, line D is between those of the spark-plugs represented by the abovementioned curves $E_3$ and $E_0$.

From comparison of curves $E_3$ to $E_6$ it is apparent that the condition of the ignition is further improved when the electrode diameter is made small and the curvature V on the discharging face is made great.

In this embodiment of FIGS. 11 to 13 the first electrode 21 is projectedly secured to the supporter 23 by such a method described in Example 1.

EXAMPLE 6 (FIG. 14)

Figure 14A:
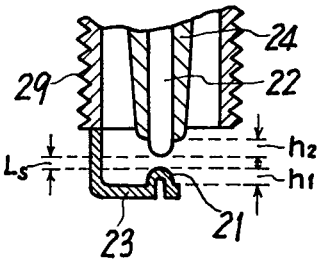
Figure 14B:
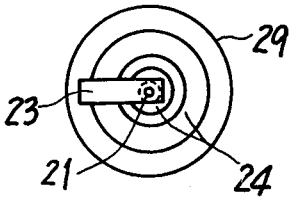

As shown in FIG. 14, the spark-plug of this embodiment is analogous to the spark-plug in FIG. 12 in the Example 5. That is, a first electrode 21 is an electrode, which is projected by a given height $h_1$ towards below a second electrode 22 in the axial direction, and has at its front end, a convex discharging face, while a second electrode 22 is an electrode, which is projected, by a given height $h_2$ from an insulator 24 and has at its front end a convex discharging face. And the first and second electrodes 21 and 22 are disposed coaxially with each other.

In this embodiment, the first electrode 21 is projected, on supporter 23, to form a convex discharging face through a knockout method. Accordingly, the present example has an advantage of easy manufacture.

EXAMPLE 7 (FIGS. 17 to 21)

Figure 20A:
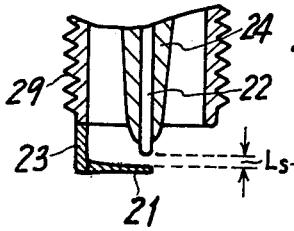
Figure 20C:
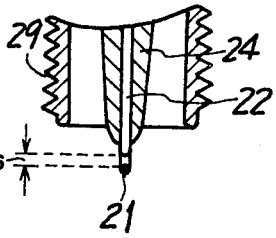
Figure 20B:
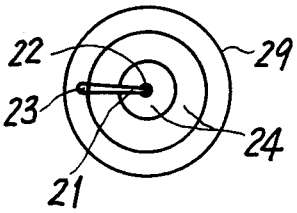
Figure 21A:
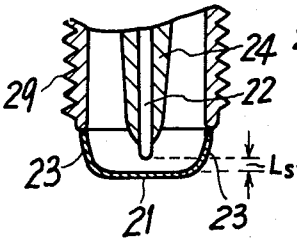
Figure 21C:
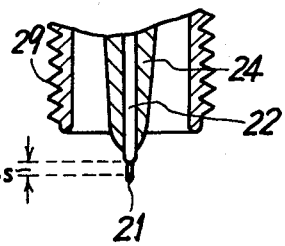
Figure 21B:
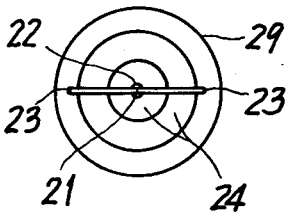

As shown in FIGS. 17 to 21, a first electrode 21 is projected from a supporter 23 by a given height, towards below a second electrode 22 vertically with respect to the axis, and has on its side face, a convex discharging face, while a second electrode 22 is projected from an electric insulator 24 by a given height, and has at its front end, a convex discharging face. Thus, a tip side face of the first electrode faces the end of the second electrode and axes of both electrodes are disposed at right angle with respect to each other. As apparent from values in Table 4, $G_1$ to $G_3$ lines, column $L_S$*, similar effects to those of FIG. 12 and FIG. 13 (Example 5 with both electrodes with convex discharging faces) are obtainable. As described hereinabefore, the spread of the electro-flame-wind is large enough to reach the rear face of the discharging plane. Accordingly, it is advantageous to use a streamline-shaped electrode for preventing occurrence of turbulence and resulting in effective improvements of the ignition condition. And the streamline-shaped electrode should have smooth curved convex face, wherein the discharging face is smoothly connected with the circumferential side part of the electrode. Similarly, it is desirable that the front end part and adjacent part of the electric insulator 24 and screw portion 29, where the electro-flame-wind or the flame nucleus during its growing stage contact, should be formed with gently-curved surfaces as shown in FIGS. 13, 20 and 21. The first electrode 21 and the supporter 23 are formed in such continuous shape as in FIG. 19, and therefore are manufactured easily through a drawing using a drawing die.

EXAMPLE 8 (FIG. 22)

Figure 22A:
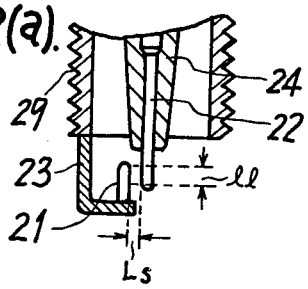
Figure 22B:
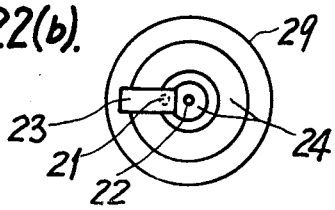

As shown in FIG. 22, in the spark-plug of this embodiment, a first electrode 21 is projected, by a given height, towards a second electrode 22 in a direction parallel to the central axis of the metallic screw part 29, and has, on its side face, a convex discharging face, while a second electrode is projected, by a given height, from an electric insulator 24, and has, on its side face, a convex discharging face. The first and second electrodes 21 and 22 are disposed in parallel relation with given opposing lengths *ll* (for example, 2mm excepting hemispherical end parts) between the electrodes. As apparent from the $L_S$* value of lines $H_1$, $H_2$ of Table 4, the effects similar to those of FIGS. 12 and 13 (Example 5) are obtainable. The opposing lengths *ll* of electrodes 21 and 22 should be determined through consideration of electro-corrosion resisting properties, i.e., service life.

EXAMPLE 9 (FIG. 23)

As shown in FIG. 23, in the spark-plug of this embodiment, a first electrode 21 is projected from a supporter 23 by a given height, in a direction vertical to the axis towards below a second electrode 22 and has on its side face (actually, upper face), a convex discharging face, while the second electrode 22 is a rod-shaped electrode projected from an electric insulator 24 by a given height, and has at its front end, a flat discharging face, and the axes of the first and the second electrodes 21 and 22 have right angle between each other. The spark-plug of this example is formed by a combination of a rod-shaped second electrode 22 with small friction drag $\Sigma f$, and a streamlined first electrode 21 with small friction drag $\Sigma f$ and pressure drag $\Sigma p$. As shown in the $L_S$* value of lines $I_1$, $I_2$ of Table 4, the condition of ignition is improved through combined operation of the both electrodes.

EXAMPLE 10 (FIG. 24)

As shown in FIG. 24, in the spark-plug of the embodiment, a first electrode 21 is a rod-shaped electrode, which is projected vertically, by a given height, towards below a second electrode 22 in a direction vertical to the central axis of the metallic screw part 29 and has, on its side face, a flat discharging face having right angle to the axis, while a second electrode is an electrode, which is projected, by a given height, from an electric insulator 24, and has at its front end, a convex discharging face. The first and second electrodes are disposed at right angle with each other. In the spark-plug in this embodiment has a combination of thin first electrode with small friction drag $\Sigma f$ and streamlined second electrode with small friction drag $\Sigma f$ and pressure drag $\Sigma p$. As shown in the $L_S$* line of $J_1$, $J_2$ of Table 4, the condition of ignition is improved through the combined operation of the both electrodes.

EXAMPLE 11 (FIG. 20)

Both electrodes 21 and 22 of the spark-plug in this embodiment, shown in FIG. 20 and Table 4, line $G_3$, are both streamlined. The dimensions, such as thickness, of the positive electrode 21 as a first electrode are smaller than those of the negative electrode 22 as a second electrode. The dimensions should be the size measured in the direction having right angle to the discharging direction, for example, diameter for circular cylindrical electrode, diagonal line for square section cylinder electrode. Such structure of the electrode was determined, based on the new knowledge of the inventors that a positive electrode is not directly hit by the electro-flame-wind, and no defacement of the electrode due to the direct hit is made, and accordingly, the dimensions of the positive electrode 21 can be smaller or thinner than those of the negative electrode 22, without any sacrifice of the spark-plug service life.

As shown in FIG. 41, (*d*) and (*d'*), space occupied by the boundary layer $B_1$ on the positive electrode 21 is small and the turbulence is hard to occur. In addition, the boundary layer $B_2$ on the negative electrode 22 is retreated from the flame nucleus space. Accordingly, the fluid drag $\Sigma = \Sigma f + \Sigma p$ and the thermal conductance G are extremely small. Furthermore, expansion waves due to the electro-flame-wind are hard to occur in the space $\phi$ on the front face of the positive electrode 21 and the low density space of molecules are hard to form. Thus, the establishment of chain combustion is easy from the inequality (1). Through the above-described actions, the $F_L - L_S$ characteristic curve $G_3$ of the spark-plug of a type shown in FIG. 20 lies on the left and above part of FIG. 44, and therefore the lean gas mixture can be ignited sufficiently.

In the service life tests, the Ni alloy negative electrode (2.55 mm in diameter) of the spark-plug of this embodiment was less in defacement than the conventional negative electrode (1mm in diameter) of expensive heat-and-defacement resisting Au-Pd alloy (FIG. 5). Accordingly, the spark-plug of this embodiment has advantages that the low-priced Ni alloy can be used and the longer service life is provided.

In order to further improve ignition characteristics, it is recommended that the negative electrode diameter for spark-plug of this embodiment should be as thin as, for example, 1 mm.

Also, in order to provide increased mechanical firmness of the thin positive electrode 21, it is recommended that both ends of the positive electrode 21 should be secured to the screw part 29 as shown in FIG. 21.

Table 4

(Examples 5 to 11)

Figure 17A:
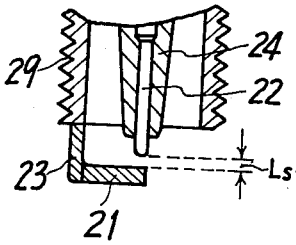
Figure 17C:
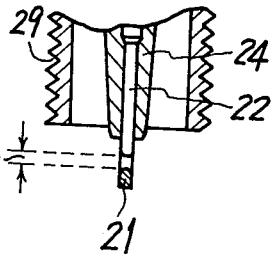
Figure 17B:
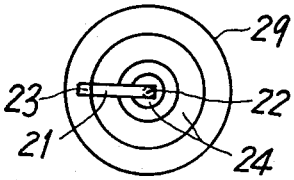
Figure 18A:
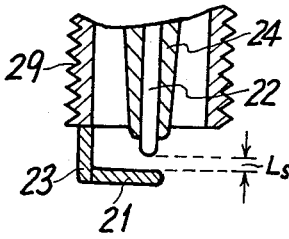
Figure 18C:
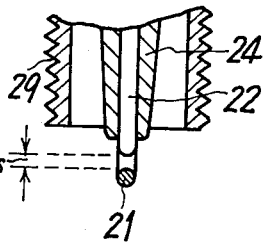
Figure 18B:
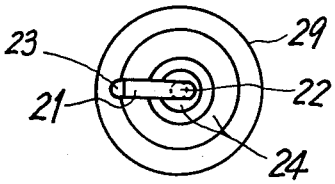
Figure 19A:
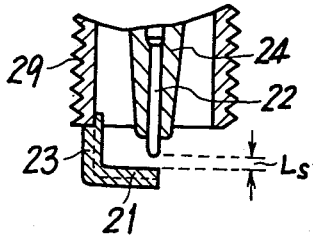
Figure 19C:
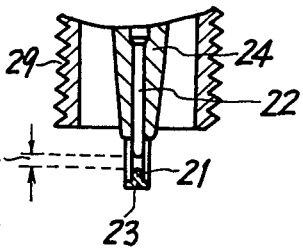
Figure 19B:
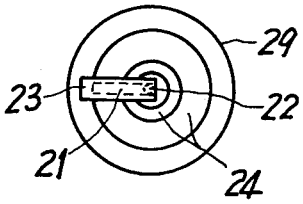

| Marks of $F_L$-$L_s$ Characteristic Curves | Types of Electrodes | Electrodes Arrangement | Grounded Electrode (First Electrode 21) Dimensions (mm) | Grounded Electrode (First Electrode 21) Curvature v ($mm^{-1}$) | High-Tension Electrode (Second Electrode 22) Dimensions (mm) | High-Tension Electrode (Second Electrode 22) Curvature v ($mm^{-1}$) | $L_s$* (mm) |
|---|---|---|---|---|---|---|---|
| D | FIG.11 | coaxial | 2.55 diameter | 0 | 2.55 diameter | 0.46 | 1.50 |
| $E_0$ | — | coaxial | 2.55 diameter | 0 | 2.55 diameter | 0 | 1.81 |
| $E_1$ | FIG.12 | coaxial | 2.55 diameter | 0.27 | 2.55 diameter | 0.27 | 1.47 |
| $E_2$ | FIG.12 | coaxial | 2.55 diameter | 0.46 | 2.55 diameter | 0.46 | 1.19 |
| $E_3$ | FIG.12 | coaxial | 2.55 diameter | 0.77 | 2.55 diameter | 0.77 | 1.16 |
| $E_4$ | FIG.12 | coaxial | 2.0 diameter | 1.0 | 2.0 diameter | 1.0 | 1.10 |
| $E_5$ | FIG.12 | coaxial | 1.5 diameter | 1.33 | 1.5 diameter | 1.33 | 1.02 |
| $E_6$ | FIG.12 | coaxial | 1.10 diameter | 2.0 | 1.0 diameter | 2.0 | 0.93 |
| ($G_1$) | FIG.17 | with right angle | 1.0 width 2.4 thickness 5 length | 2.0 | 1.0 diameter | 2.0 | 0.99 |
| $G_2$ | FIG.18 | with right angle | 2.55 diameter 5 length | 0.77 | 2.55 diameter | 0.77 | 1.10 |
| $G_3$ | FIG.20 | with right angle | 0.34 diameter | 5.88 | 2.55 diameter | 0.77 | 1.02 |
| ($H_1$) | FIG.22 | parallel with opposing lengths ll=2.0mm | 2.55 diameter 5 length | 0.77 | 2.55 diameter 5. length | 0.77 | 1.45 |
| ($H_2$) | FIG.22 | parallel with opposing lengths ll=2.0mm | 1.0 diameter 6 length | 2.0 | 1.0 diameter 6 length | 2.0 | 1.42 |
| ($I_1$) | FIG.23 | with right angle | 1.0 width 2.4 thickness 5 length | 2.0 | 1.0 diameter | 0 | 1.40 |
| ($I_2$) | — | with right angle | 2.5 diameter | 0.77 | 1.0 diameter | 0 | 1.54 |
| ($J_1$) | FIG.24 | with right angle | 1.0 width 1.3 thickness 5 length | 0 | 1.0 diameter | 2.0 | 1.40 |
| ($J_2$) | — | with right angle | 1.0 width 1.3 thickness 5 length | 0 | 2.55 diameter | 0.77 | 1.40 |

Note: Curve for ($G_1$) is almost analogous to that of $G_2$ or $G_3$ and curves for ($H_1$), ($H_2$), ($I_1$), ($I_2$), ($J_1$) and ($J_2$) are almost analogous to that of $E_1$ or $E_2$, and therefore, are not shown in the graphs.

The next Example 12 relates to a spark-plug, wherein at least one of said electrodes circumferential portion connected to the discharging face is formed streamlined.

EXAMPLE 12 (FIGS. 25 to 28)

Figure 44:
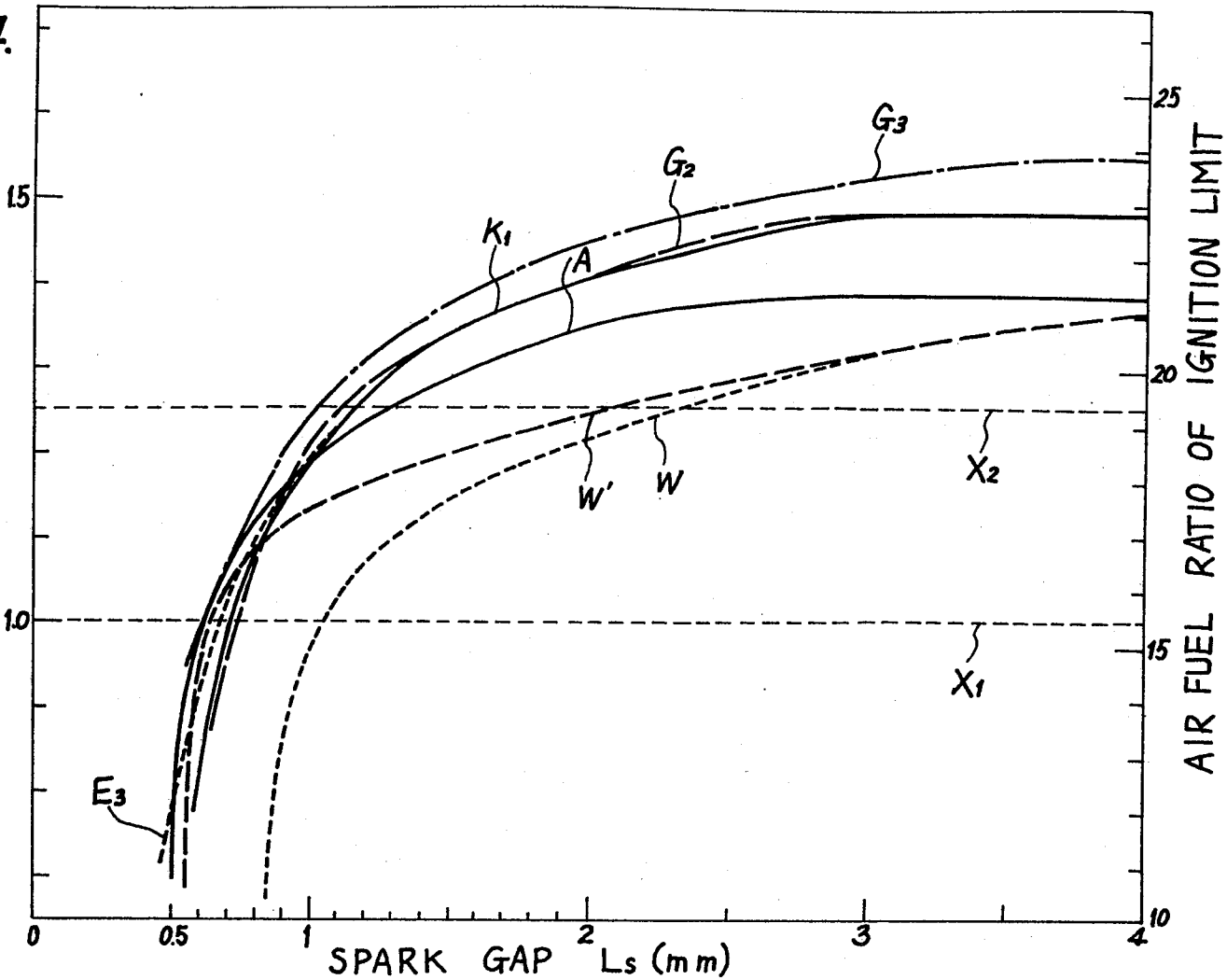

As shown in FIG. 25 and 27 and in the line $K_1$ of Table 5, in the spark-plug of this Example, in at least one (having diameter of *d*) of a first and a second electrodes 21 and 22, the end faces are made approximately flat circular (having radius *r*) discharging faces $S_1$-$S_1$, and the circumferential part which is connected to the discharging face $S_1$-$S_1$ has convex face $S_1$-$S_2$ connected to the discharging face $S_1$-$S_1$, without edges between its circumferential part and the discharging face $S_1$-$S_1$. Such structure leads to an advantage that, as shown by FIG. 44, curves $K_1$ for this Example 12 and A for Example 1, respectively, the ignition characteristics of this Example 12 are improved in region for such wide electrode gap Ls >1 mm, wherein a turbulent flow is likely to be produced because of speed-increasing electro-flame-wind.

Also, the electrode of the spark-plug of this Example can be made by slicing the front end part of the hemispherical end face shown in FIG. 12, thereby to form circle plane of, for example, 1 mm in diameter. Thus, in terms of the igniting characteristics, as shown in FIG. 44, the characteristic curve $K_1$ of this spark-plug is slightly poorer in the range of LS <1 mm than the characteristic curve $E_3$ of the spark-plug of FIG. 12. However, this Example 12 is remarkably superior in terms of durability, since the discharging spots are not concentrated in one point.

As described hereinbefore, such spark-plugs having the pair of an electrode with almost flat discharging face of small area and turbulence-preventing streamlined (convex face) circumferential part connected to the discharging face, both facing each other, has almost superior features of the $F_L$-$L_s$ characteristics of the spark-plugs wherein each electrode has turbulence-preventing streamlined discharging face, and furthermore is superior in durability due to the construction to prevent the discharging spots from concentrating in one point.

Figure 28A:
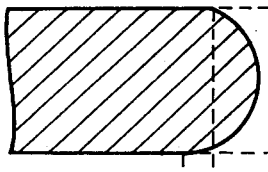
Figure 28C:
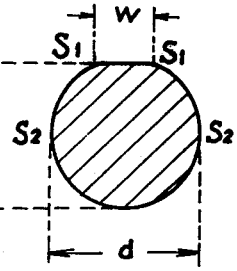
Figure 28B:
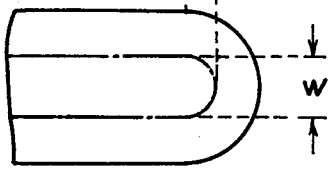

As apparent from the values of line $K_2$ or $K_3$, column $L_s$* of Table 5, the effects of the above Example 12 are obtainable even in a spark-plug shown by FIG. 26 and Table 5, line $K_2$ where both electrodes are disposed at right angle with each other, and even in spark-plug of Table 5, line $K_3$ where both electrodes are disposed in parallel to each other. FIG. 28 shows a magnified sectional view of the positive electrode 21 of FIG. 26. Referring to the drawing, *w* designates the width of the discharging face $S_1$-$S_1$, $S_1$-$S_2$ designates streamlined convex side face for preventing the occurring of the turbulence, *d* designates an electrode diameter.

Table 5

(Example 12)

| Marks of $F_L$-$L_S$ Characteristic Curves | Types of Electrodes | Electrodes Arrangement | Grounded Electrode (First Electrode 21) Dimensions (mm) | High-Tension Electrode (Second Electrode 22) Dimensions (mm) | $L_S$* (mm) |
|---|---|---|---|---|---|
| $K_1$ | FIG.25 | coaxial | 2.55 diameter of electrode 1.0 diameter of discharging face | 2.55 diameter of electrode 1.0 diameter of discharging face | 1.16 |
| ($K_2$) | FIG.26 | with right angle | 2.55 diameter of electrode 1.0 width and 5 length of discharging face | 2.55 diameter of electrode 1.0 diameter of discharging face | 1.21 |
| ($K_3$) | — | parallel with opposing lengths ll=1.0mm | 2.55 diameter of electrode 1.0 width and 5 length of discharging face | 2.55 diameter of electrode 1.0 width and 5 length of discharging face | 1.34 |

Note: Curves for ($K_2$) and ($K_3$) are almost analogous to that of $K_1$, and therefore, are not shown in the graphs.

The following Examples 13 to 16 relate to spark-plugs with electrodes, at least one of the electrodes having a recess on a part of its face that is facing the other electrode.

EXAMPLE 13 (FIGS. 29 to 33)

Figure 29A:
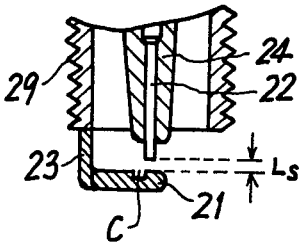
Figure 29B:
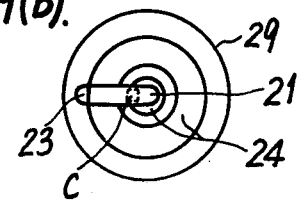
Figure 30A:
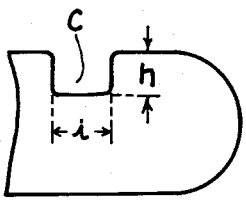
Figure 30C:
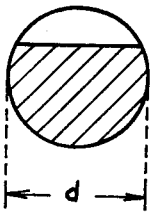
Figure 30B:
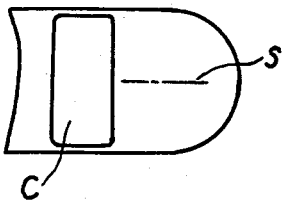

In the spark-plug of this embodiment, as shown in FIG. 29 and 30, a first electrode (diameter *d*) 21 is projected by a given height from a supporter 23 vertically towards below a second electrode 22 in a direction vertical to the central axis of the metallic screw part 29, while the second electrode 22 is projected by a given height from an electric insulator 24, at least one, for example, the first electrode 21, of the first and second electrodes 21 and 22 having a recess on a part of its face that is facing the other electrode 22. The recess *c* (depth *h*, length i) is formed not in a part directly facing the discharging face s of the second electrode 22, but in another part adjacent to the abovementioned direct-facing part. The discharging face of the first electrode 21 and a circumferential part coupling to this discharging face form a convex face (streamline type).

The recess serves to prevent the occurrence of turbulence, namely, the pressure drag Σ p and to reduce the thickness of the boundary layer. The prevention of the occurrence of turbulence is made by inhaling such part of the boundary layer on the long electrode, that is close to the electrode wall and hence is liable to separation through losing kinetic energy due to shearing stress on wall plane. The reducing of the thickness of the boundary layer is made by retreating the boundary layer from the flame nucleus space. In addition, the first electrode has the convex discharging face, and therefore, the friction drag Σf and the pressure drag Σp are both satisfactorily small. Therefore, the fluid drag Σ becomes small and the thermal conductance G becomes small to improve the condition of ignition remarkably.

Also, the effect given by the recess c in this spark-plug electrode is the same as that given by the projection of electrode described in Example 1. Accordingly, it is desirable to make the depth of the recess c as deep as approximately 0.25mm or more, like the projection height $h_1$ and/or $h_2$ of Example 1 being so.

Figure 31A:
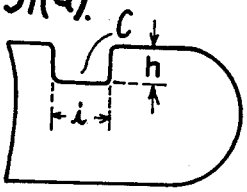
Figure 31C:
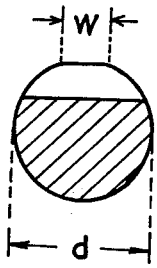
Figure 31B:
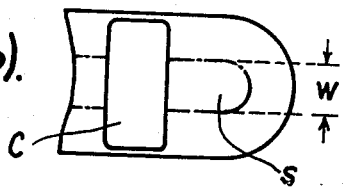

FIG. 31 shows a spark-plug electrode, having a small flat discharging face *s* (width *w*) made by slicing a part of the convex discharging face of the spark-plug electrode of FIGS. 29 and 30. A spark-plug using this electrode has similar superior ignition characteristics to those of FIGS. 29 and 30. Besides, the Example of FIG. 31 is advantageous in terms of durability, since the discharging spots are not concentrated in narrow part.

Figure 32A:
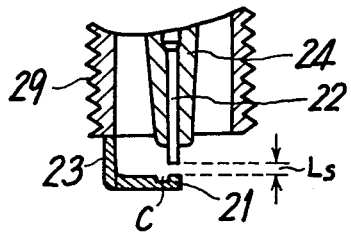
Figure 33A:
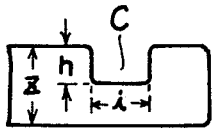
Figure 33C:
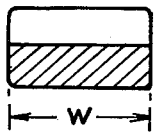
Figure 32B:
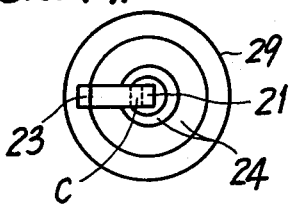
Figure 33B:
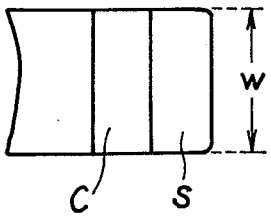

Also, in order remarkably to simplify manufacturing, as shown in FIGS. 32 & 33, and Table 6, line M, a spark-plug may also be made by using a square rod electrode of width *w*, thickness *z* with a recess *c* (depth *h*, length *i*). In FIG. 33, *s* is discharging plane). The recess is not in a part of a face that is facing the other electrode but in another part adjacent to the directfacing part. This spark-plug is also improved in the condition of the ignition due to small pressure drag Σ*p* and friction drag Σ*f* as shown in the $L_s$* value of the line M of Table 6.

Figure 34A:
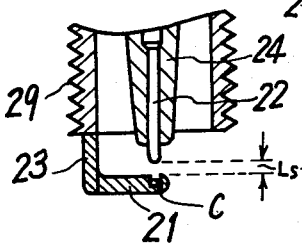
Figure 34C:
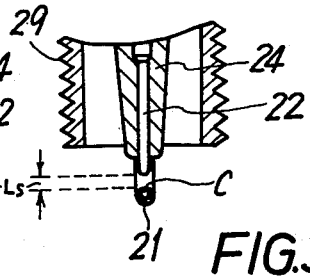
Figure 34B:
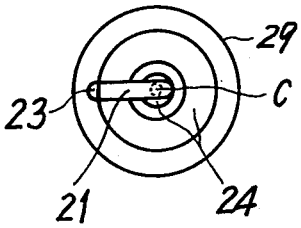
Figure 35A:
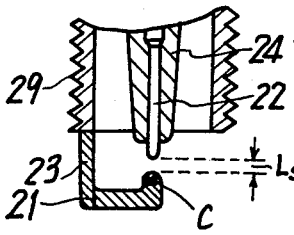
Figure 35C:
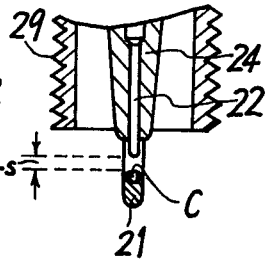
Figure 35B:
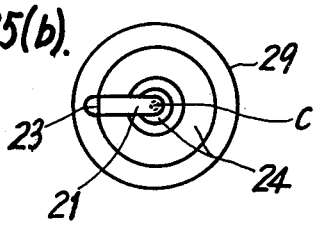

EXAMPLE 14 (FIGS. 34 and 35)

As shown in FIG. 34 and Tabel 6, line $N_1$, in the spark-plug of this embodiment, a first electrode 21 is projected by a given height from a supporter 23 vertically towards below a second electrode 22 in a direction vertical to the central axis of the metallic screw part 29. And the discharging face and the circumferential part are forming continuous convex face (streamline shape). The second electrode 22 is projected by a given height from an insulator 24. And the discharging face and the circumferential part are forming continuous convex face (streamline shape). At least one electrode of the first and second electrodes 21 and 22 has a recess c in the discharging face, of the one electrode (for example, first electrode 21), which is directly facing the discharging face of the other electrode (for example, the second electrode 22).

As shown in FIG. 41, (*f*) and (*f'*), in the spark-plug of this Example, the expansion waves, which caused in the space $\phi$ of the discharging face of the first electrode due to the electro-flame-wind are offset by gas molecules supplied from the recess c as reservoir of gas. Accordingly, the discharging face of the first electrode 21 is not liable to become the space of low molecular density. Thus, the e in the inequality (1) does not become small, and accordingly, the establishment of chain combustion becomes easy.

Furthermore, as shown in FIG. 41, (*f'*), this spark-plug has an effect of reducing Σ*f*, since as a result of forming the recess c the boundary layer $B_1$ formed along the first electrode 21 becomes thinner than the boundary layer of the first electrode (for example, FIG. 41(*e'*)) not equiped with recess *c*. Furthermore, since both electrodes are formed streamlined, the turbulences are hard to form, and therefore, the Σp becomes small.

Figure 45:
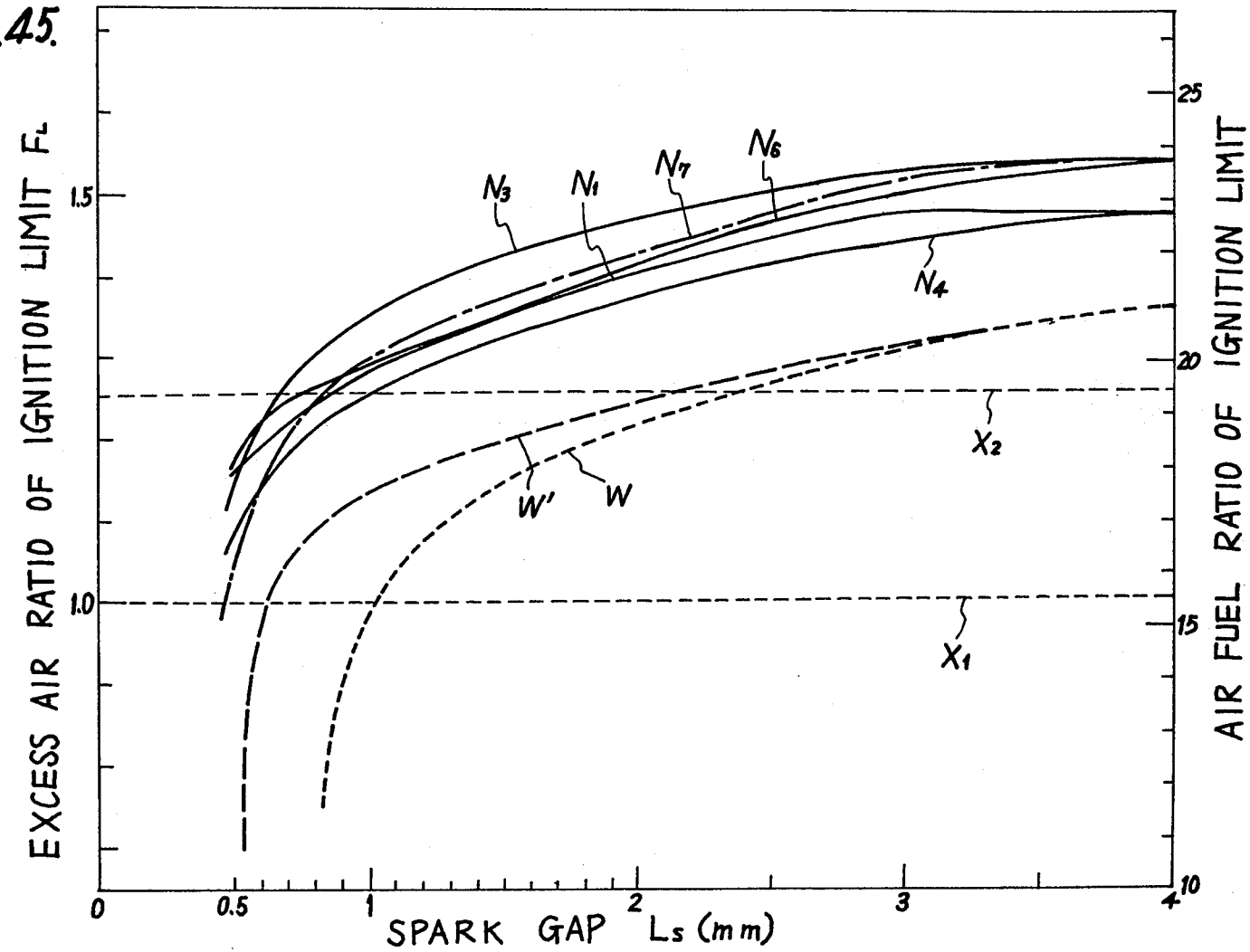

Such $F_L$-$L_s$ characteristics of the spark-plug of this Example as shown in the curve $N_1$ of FIG. 45 are obtainable, through the compound effects, of preventing the formation of the space of low density of molecules, reducing the boundary layer $B_1$ in thickness and preventing the occurrence of the turbulent flow due to streamlined shape. Namely, not only in a relatively long electrode gap region, but also in a relatively short electrode gap region, ignition of lean mixture can be made sufficiently.

Also, in order to provide further improved ignition characteristics, as shown in FIG. 35 and Table 6, line $N_3$, it is recommended coaxially to arrange the first electrode 21 with gas reservoir recess c and the second electrode 22. Through this arrangement, the dimensions *l* of the first electrode 21 can be made effectively small and the friction drag Σ*f* and the thermal conductance G decrease. Accordingly, as shown in the curve $N_3$ of FIG. 45, easy lean gas ignition is further made possible. The same operating effect as described hereinbefore is obtainable even with a through hole as the gas reservoir recess c of the first electrode 21. As shown in the $L_s$* value of line $N_2$ of Table 6, the lean mixture ignition can be effected sufficiently with such through hole. This spark-plug has advantages in that the gas reservoir hole hardly be clogged with dusts, and easier in cleaning when the reservoir hole is clogged with dusts.

It is also recommended to arrange the electrodes 21 and 22, at least one of which electrodes has said recess, in parallel to each other with their discharging faces of respective given lengths opposing to each other, in order to improve the electro-corrosion resistivity.

EXAMPLE 15 (FIG. 36)

Figure 36A:
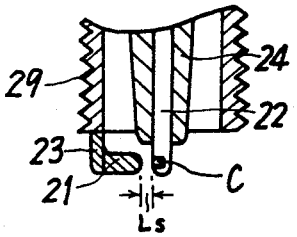
Figure 36C:
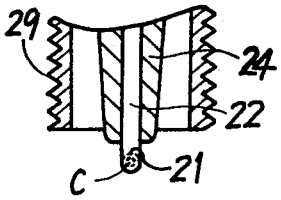
Figure 36B:
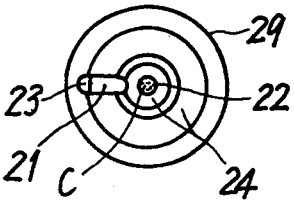

As shown in FIG. 36 and in Table 6, line $N_4$, a second electrode 22 as a negative electrode has such gas reservoir recess c.

In a spark-plug of this Example shown in FIG. 41 (*g*), (*g'*), electric field is negligibly small inside the recess c. Accordingly, when the electro-flame-wind, which has been accelerated in the electric field in the electrode gap $L_s$, rushes into the recess c and the electro-flame-wind is not accelerated any more. Accordingly, the positive ions in the electro-flame-wind lose the momentum, the kinetic energy, etc. while colliding against the neutral molecules, and are sufficiently decelerated before positive ions reach the wall ψ of the recess c. In other words, the electro-flame-wind can effectively deliver its own thermodynamic quantity to the unburned mixture inside the recess c, and on the other hand the collision of the electro-flame-wind against the negative electrode wall ψ is relieved. Thus, the direct loss of the thermodynamic quantity caused through the collison of the electro-flame-wind to the negative electrode is reduced remarkably. Furthermore, this spark-plug has more effect of thinning boundary layer $B_2$ formed along the negative electrode 22(as shown in FIG. 41(*g'*) ) than that of the negative electrode that has no recess (e.g. FIG. 40, (*e'*)), and hence, the Σ*f* is also reduced. Besides, the turbulent flow hardly occurs because of the streamline shape of both electrodes 21 and 22, and therefore, Σp becomes small. As is seen from the $F_L$-$L_s$ characteristics (FIG. 45, curve $N_4$) of the spark-plug of this embodiment, through the compound effects of preventing the direct collision of the electric-flame-wind against the negative electrode will ψ by means of recess c, reducing the boundary layer $B_2$ in thickness, and preventing the occurrence of the turbulent flow by means of streamline shape, the lean mixture ignition can be sufficiently effected not only in a relatively long electrode gap region, but also in a relatively short electrode gap region.

Also, the ignition characteristics are further improved as shown in the curve $N_6$ of FIG. 45 if the positive electrode 21 and the negative electrode 22 with the recess c are disposed coaxially each other as shown in Table 6, line $N_6$.

Even when the gas reservoir recess c in the negative electrode 22 is made as a through hole, the same operating effect as described hereinbefore is provided and thus the lean mixture ignition can be sufficiently effected as shown in the $L_s$* value of the line $N_5$ of Table 6. This spark-plug has advantages in that the gas reservoir is hardly clogged with dusts, etc. and easier in cleaning even if clogged with the dusts.

EXAMPLE 16

The spark-plug of this embodiment has a gas reservoir recess, on both electrodes as shown in Table 6, line $N_7$. As is seen from the ignition characteristics in FIG. 45, curve $N_7$, the lean gas mixture ignition can be sufficiently effected by the spark-plug, of this embodiment by means of combined operation between the operating effect of the gas reservoir recess of the positive electrode 21 and the operating effect of the gas reservoir recess of the negative electrode 22.

Table 6

| Marks of $F_L L_S$ Characteristic Curves | Types of Electrodes | Electrodes Arrangement | (Examples 13 to 16) Grounded Electrode (First Electrode 21) Dimensions (mm) of Electrode | Dimensions (mm) of Recess | High-Tension Electrode (Second Electrode 22) Dimensions (mm) | Dimensions (mm) of Recess | $L_S$* (mm) |
|---|---|---|---|---|---|---|---|
| (M) | FIG. 32 | with right angle | 2.7 width 1.13 thickness 5 length | 0.45 depth 1.13 width 0.96 length | 1.0 diameter | None | 1.64 |
| $N_1$ | FIG.34 | with right angle | 2.55 diameter | 1.0 diameter 1.93 depth | 1.0 diameter | None | 0.84 |
| ($N_2$) | — | with right angle | 2.55 diameter | 1.0 diameter (through hole) | 1.0 diameter | None | 0.97 |
| $N_3$ | FIG.35 | coaxial | 2.55 diameter | 1.0 diameter 1.84 depth | 1.0 diameter | None | 0.66 |
| $N_4$ | FIG.36 | with right angle | 2.55 diameter | None | 2.55 diameter | 1.0 diameter 1.93 depth | 0.97 |
| ($N_5$) | — | with right angle | 2.55 diameter | None | 2.55 diameter | 1.0 diameter (through hole) | 1.03 |
| $N_6$ | — | coaxial | 1.0 diameter | None | 2.55 diameter | 1.0 diameter 1.84 depth | 0.72 |
| $N_7$ | — | coaxial | 2.55 diameter | 1.0 diameter | 2.55 diameter | 1.0 diameter | 0.84 |

Table 6-continued

| Marks of $F_L L_S$ Characteristic Curves | Types of Electrodes | Electrodes Arrangement | (Examples 13 to 16) Grounded Electrode (First Electrode 21) Dimensions (mm) of Electrode | Dimensions (mm) of Recess | High-Tension Electrode (Second Electrode 22) Dimensions (mm) | Dimensions (mm) of Recess | $L_S$* (mm) |
|---|---|---|---|---|---|---|---|
| | | | | 1.84 depth | | 1.84 depth | |

Note: Curve for (M) is almost analogous to that of $E_1$ and Curves for ($N_2$) and ($N_3$) are almost analogous to that of $N_4$, and therefore, are not shown in the graphs.

The following Example 17 relates to three-electrode type spark-plug wherein an electrode for trigger discharge is added to the spark-plugs of all the Examples 1 to 16.

Figure 16A:
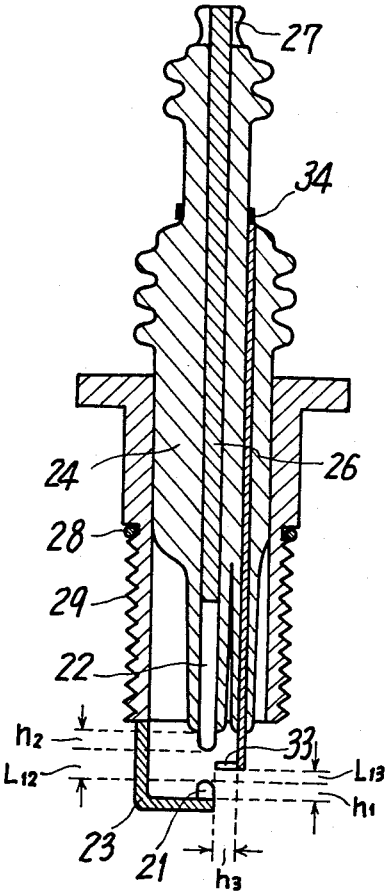
FIG. 16 shows one embodiment of three-electrode spark-plugs of the present invention, the (a) thereof being the sectional side view and the (b) thereof being the bottom view.
Figure 16B:
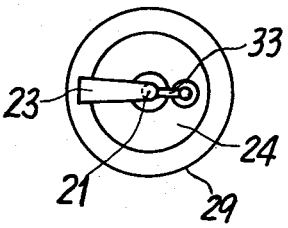

Example 17 (FIG. 16)

A spark-plug of this Example, as shown in FIG. 16, is formed by adding a trigger electrode 33 (Projection height $h_3$), which has the form, size and arrangement of small fluid resistance with respect to the electro-flame-wind, in a position of distance $L_{13}$ from the positive electrode 21, to any of the preceding type of spark-plug, for instance, in FIG. 12 wherein two-electrodes are provided. The main electrodes 21 and 22 are disposed to face each other with the main electrode gap distance $L_{12}$ inbetween.

In the spark-plug of this construction, the fluid resistance of the electrodes is small, and therefore the thermal conductance G is small. The main discharge limit gap with respect to a given applied voltage pulse can be enlarged up to approximately 1.75 times the discharge limit gap of the abovementioned two-electrode spark-plugs, so that the main electrode gap distance $L_s$, and hence, the flame nucleus volume V can be selected large. Accordingly, the condition of the ignition of an inequality (1) is improved and accordingly very lean mixture can be ignited.

In case of this three-electrode spark-plug, the spark-plug can be driven by means of an ordinary ignition power source for two-electrode spark-plugs without using other power source, by connecting terminal 34 to the metallic screw part 29 or to a high tension electrode terminal through a resistor or a capacitor.

The following Example 18 relates to a spark-plug of surface creeping discharge type wherein a surface creeping discharge path is on the face of an electric insulator 24 between a first electrode 21 and a second electrode 22.

Figure 38A:
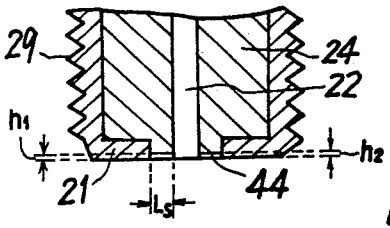
FIG. 38 to FIG. 40 show one embodiment of the spark-plugs of surface creeping discharge type of this invention, respectively, the (a)s thereof being the sectional side views, the (b)s thereof being the bottom views.
Figure 39A:
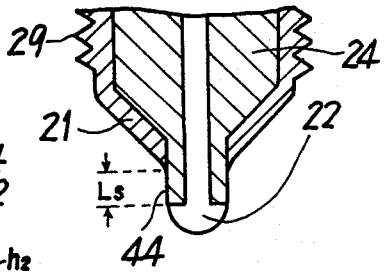
Figure 40A:
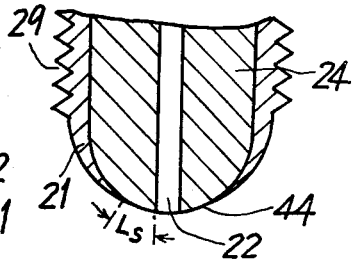
Figure 39B:
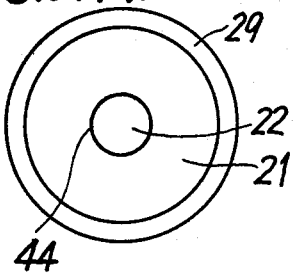
Figure 38B:
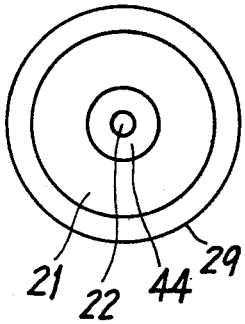
Figure 40B:
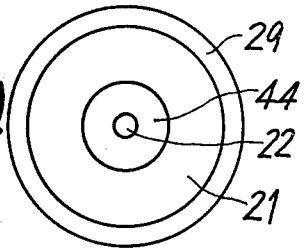

EXAMPLE 18 (FIGS. 38 to 40)

As shown in FIG. 38, in the spark-plug of this Example 18, the first and second electrodes 21 and 22 are projected by a given heights $h_1$ and $h_2$, respectively, above the face of the surface creeping discharge path 44. Both of these projection heights $h_1$ and $h_2$ are as low as, for example, 0.3mm or less.

Figure 37A:
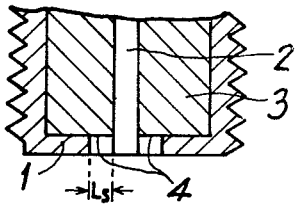
FIG.37(a). (Prior art)
FIG. 37 shows one example of the conventional spark-plugs of surface creeping discharge type.
Figure 37B:
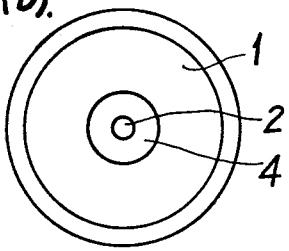

The $F_L$-$L_S$ characteristics of this spark-plug are remarkably enough improved to ignite the sufficiently lean mixture, as compared with the $F_L$-$L_S$ characteristics of the conventional spark-plug of surface creeping discharge type (FIG. 37) with the first electrode 1 and the second electrode 2 both projected by approximately 0.5mm above the surface creeping discharging path 4. This effect is obtained through the improved condition of the ignition as can be understood from the inequality (1), since the respective projection heights $h_1$, $h_2$ of the electrodes 21 and 22 of this spark-plug have been made small, and thus the dimensions $l$ of the discharging faces of the opposing electrodes become effectively small to reduce the friction drag $\Sigma f$, hence, the thermal conductance G.

In order to provide easier ignition of the lean mixture, it is recommended that as shown in FIG. 39 and FIG. 40, the electrode projection heights from the surface creeping path 44 should be 0.3mm or less alike the spark-plug of the FIG. 38, the shape of the electrodes should be of gentle convex faces, and the shape of the surface creeping discharge path 44 of the electric insulator 24 should be, also, of gentle convex face.

In addition, in order to widen the main electrode gap distance, it is also recommended that a trigger discharge electrode be added to the surface creeping discharge type spark-plug of this embodiment to use as a three-electrode type spark-plug.

As described elucidating, the abovementioned eighteen examples, the spark-plugs and engines of this invention have superior ignition characteristics which ensure positive and reliable ignition under conditions where combinations of temperature, pressure and concentration of the gas mixture are hard for ignition. The spark-plug and engine make it possible to ignite and burn the lead gas mixture of 1.25 or more in excess air ratio F, under the normal temperature, 1 atmospheric pressure, and with an electrode gap narrower than Ls=2mm with which ignition has been impossible with conventional spark-plugs and engines.

What we claim is:

1. An electric spark-plug for automobile internal combustion engine comprising:

a metallic screw portion to be engaged with an internal combustion engine, an electrode terminal part, an electric insulator for supporting said screw part and said electrode terminal part in a coaxial relation, keeping them insulated from each other, and at least a pair of electrodes, the pair including a first electrode and a second electode, said first electrode being supported by a supporter formed on the metallic screw part, said second electrode being rod-shaped and electrically connected to said electrode terminal part by means of a central conductor disposed on the axis of said screw part and in said insulator, said first electrode and said second electrode being supported insulatedly from each other by means of said insulator, keeping a given ignition gap between their discharging faces, characterized in that:

fluid resistance against gas flow of flame nucleus of said electrodes is decreased in a manner to have an ability of ignition that is defined by capability to ignite and burn a lean gas mixture of isobutane and air under the conditions of normal temperature (T) of about 20° C, the pressure of lean gas mixture equals 1 atmospheric pressure (density index $\epsilon \approx 1$), excess air ratio (F) of more than 1.25 and electrode gap distance ($L_s$) of less than 2mm, so that the following ignition conditional inequality applies thereby to decrease the thermal conductance G from the flame nucleus to the electrodes:

$$J > \frac{G}{V}\left\{\frac{\exp(E_b/RT}{(\alpha-1)B\epsilon^{n+m*}} \cdot \frac{(n+4.773\,mF)^{n+m*}}{3.773^{\gamma m}\,n^n m^{m*}\,(X_t-X_i)^{n+m*}\,F^{m*}}\right\} \quad (1)$$

wherein J, $\epsilon$ and $m^*$ are given by $$J = [E_b(T_s - T_o) + RT_s^2]/\pi RT_s^2,$$

$$\epsilon = [(760 - p^-) / 760]\, R_c,$$

$$m^* = (1 + \gamma)m,$$

wherein V is the nucleating volume size and is represented by an equation of $V=\theta L_s$ wherein $\theta$ is a proper constant and $L_3$ is the electrode gap distance, T is a temperature of the nucleating volume, $T_o$ is the temperature of the electrodes, $X_i$ is a molar density in 1 atmospheric pressure of incombustible gases other than nitrogen, F, $\epsilon$ $p^-$ and $R_c$ are excess air ratio, density index of molecules, absolute value of negative pressure (mm Hg) in intake pipe and compression ratio at the time of ignition, respectively, in the gas mixture, J being practically a constant when the dependences of the singular point temperature $T_s$ upon the variable quantities V, G, $X_i$, F and $\epsilon$ are sufficiently small, $E_b$ is an activation energy in Arrhenius' equation, and is a constant inherent to individual fuel, n and m are the molecularities of reaction of fuel and oxygen, respectively, $\gamma$ is a parameter showing the participation degree of nitrogen molecules in reaction process, $\alpha$ is a multiplication factor of chain carriers, R is a gas constant, B, $X_t$ and $\pi$ are constants, respectively.

2. An electric spark-plug for internal combustion engine according to claim 1 wherein the first and second electrodes are rod-shaped electrodes, respectively, the rod-shaped electrode having discharging face at its front end and being 1.7mm or less in diameter in case the cross-sectional view of the electrode is circular, and in the longest diagonal line length in case the cross-sectional view thereof is polygonal, and the other rod-shaped electrode having discharging face at its side face and being 1.2mm or less in width and 2mm or less in thickness.

3. An electric spark-plug for internal combustion engine according to claim 2 wherein said first electrode is a rod-shaped electrode, which is projected in the axial direction towards a second electrode from the supporter by a given height and has at its front end, a flat discharging plane perpendicular to the axis, while said second electrode is a rod-shaped electrode, which is projected by a given height from said electric insulator, and has a flat discharging plane having right angle with said axis, the first and second rod-shaped electrodes being disposed in a coaxial relation with respect to each other.

4. An electric spark-plug for internal combustion engine according to claim 2 wherein said first electrode is a rod-shaped electrode, which is projected by a given height from the supporter towards a second electrode in a direction perpendicular to the axis, and has at its front end a discharging plane parallel to the axis, while said second electrode is a rod-shaped electrode which is projected by a given height, from said central conductor in a direction perpendicular to said central conductor, and has a discharging plane parallel to the axis and facing the discharging plane of said first electrode.

5. An electric spark-plug for internal combustion engine according to claim 2 wherein said first electrode is a rod-shaped electrode which is projected in the direction perpendicular to the axis towards a second electrode from the supporter by a given height and has, on its side face, a discharging plane which is at right angle with the axis, while said second electrode is a rod-shaped electrode which is projected by a given height from the electric insulator and has, on its front end, a discharging plane which is at right angles with the axis, the axes of said first and second rod-shaped electrodes being disposed at right angle with each other.

6. An electric spark-plug for internal combustion engine according to claim 2 wherein said first electrode is a rod-shaped electrode which is projected by a given height from the supporter towards a second electrode in a direction parallel to the axis, and has, on its side face, a discharging face which is parallel to the axis while said second electrode is a rod-shaped electrode which is projected by a given height from the electric insulator and has on its side face, a discharging face parallel to said axis, the axes of said first and second rod-shaped electrodes being disposed in parallel to each other.

7. An electric spark-plug for internal combustion engine according to claim 2 which further comprises a trigger electrode.

8. An electric spark-plug for internal combustion engine according to claim 1 wherein at least one of said first and second electrodes has a convex discharging face.

9. An electric spark-plug for internal combustion engine according to claim 8 wherein said first electrode is an electrode which is projected by a given height from the supporter toward said second electrode in the axial direction and has, on its front end, a discharging plane which is at right angle to the axis, while said second electrode is an electrode which is projected by a given height from the electric insulator and has, on its front end, a convex discharging face with a curvature in the range of $0.46mm^{-1}$, said discharging face and its circumferential part forming a continuous convex face, said first and second electrodes being disposed in a co-axial relation with each other.

10. An electric spark-plug for internal combustion engine according to claim 8 wherein said first electrode is an electrode which is projected by a given height from the supporter toward said second electrode in the axial direction, and has on its front end, a convex discharging face, while said second electrode is an electrode which is projected by a given height from the electric insulator and has on its front end, a convex discharging face with a curvature in the range of $0.46mm^{-1}$, said discharging face and its circumferential part forming a continuous convex face, said first and second electrode being disposed in coaxial relation with respect to each other.

11. An electric spark-plug for internal combustion engine according to claim 8 wherein said first electrode is an electrode which is projected by a given height towards said second electrode in a direction perpendicular to the axis and has on its side face, a convex discharging face with a curvature of at least 0.46 $mm^{-1}$, said discharging face and the circumferential part forming a continuous convex face, while said second electrode is an electrode which is projected by a given height from the electric insulator, and has on its front end, a convex discharging face with a curvature of at least 0.46 $mm^{-1}$, said discharging face and the circumferential part forming a continuous convex face, said first and second electrodes being disposed at right angle with each other.

12. An electric spark-plug for internal combustion engine according to claim 8 wherein said first electrode is an electrode which is projected by a given height from the supporter towards said second electrode in a direction parallel to the axis and has, on its side face, a convex discharging face, while said second electrode is an electrode which is projected by a given height from the electric insulator and has, on its side face, a convex discharging face, said first and second electrodes being disposed in parallel to each other.

13. An electric spark-plug for internal combustion engine according to claim 8 wherein said first electrode is an electrode which is projected by a given height from the supporter vertically towards below said second electrode in a direction vertical to the axis, and has on its side face, a convex discharging face, while said second electrode is a rod-shaped electrode which is projected by a given height from the electric insulator, and has on its front end, a discharging plane which has right angle with said axis, axes of first and second electrodes being disposed at right angle with each other.

14. An electric spark-plug for internal combustion engine according to claim 8 wherein said first electrode is a rod-shaped electrode which is projected by a given height from the supporter perpendicularly towards said second electrode in a direction perpendicularly to said axis, and has on its side face, a discharging plane which is at a right angle with said axis, while said second electrode is an electrode which is projected by a given height from the electric insulator, and has on its front end, a convex discharging face, said discharging face and its circumferential part forming a continuous convex face, said first and second electrodes being disposed at right angle with each other.

15. An electric spark-plug for internal combustion engine according to claim 8 wherein at least a negative electrode has a convex discharging face, said convex discharging face and its circumferential part forming a continuous convex face, and said positive electrode is made smaller in size measured in the direction extending at a right angle to the discharging direction from said negative electrode.

16. An electric spark-plug for internal combustion engine according to claim 8 wherein at least one of said electrodes has on its side face, a convex discharging face, and a curved circumferential part smoothly connected to said discharging face.

17. An electric spark-plug for internal combustion engine according to claim 8 which further comprises an electrode for trigger discharge.

18. An electric spark-plug for internal combustion engine according to claim 1 wherein at least one of said electrodes has a recess on an extended part of its discharging face, said discharging face and its circumferential part forming a continuous convex face.

19. An electric spark-plug for internal combustion engine according to claim 18 wherein said first electrode is projected by a given height from the supporter perpendicularly towards said second electrode in a direction perpendicular to the axis, said second electrode is projected by a given height from the electric insulator, at least one of said first and second electrodes having a recess on a position which is adjacent to and on a face continuous to said discharging face.

20. An electric spark-plug for internal combustion engine according to claim 18 wherein said first electrode is projected by a given height from the supporter towards said second electrode in a direction perpendicular to the axis, said second electrode is projected by a given height from the electric insulator, at least one of said first and second electrodes having said recess on the discharging face at a position correctly facing the discharging face of the other electrode.

21. An electric spark-plug for internal combustion engine according to claim 18 wherein said first electrode is projected by a given height from the supportor towards below a second electrode in a direction parallel to the axis, said second electrode is projected by a given height from the electric insulator, said first and second electrodes being disposed coaxially with each other at least one of said first and second electrodes having said recess on the discharging face at a position correctly facing the discharging face of the other electrode, said discharging face and its circumferential part forming a continuous convex face.

22. An electric spark-plug for internal combustion engine according to claim 18 wherein said first electrode is projected by a given height from the supportor towards said second electrode in a direction parallel to the axis, said second electrode is projected by a given height from the electric insulator, said first and second electrode being disposed in parallel to each other, and at least one of said first and second electrodes having said recess on the discharging face at a position correctly facing the discharging face of the other electrode.

23. An electric spark-plug for internal combustion engine according to claim 18 which further comprises an electrode for trigger discharging.

24. An electric spark-plug for internal combustion engine according to claim 1 wherein a surface creeping discharge path between said first and second electrodes is formed on the surface of said insulator.

25. An electric spark-plug for internal combustion engine according to claim 24 wherein said first and second electrodes are projected, respectively, by 0.3 mm or less above the surface of said surface creeping discharge path.

26. An electric spark-plug for internal combustion engine according to claim 24 wherein the surface creeping discharge path is on a convex face and both of said first and second electrodes are projected, by 0.3mm or less over said surface creeping discharge path.

27. An electric spark-plug for internal combustion engine according to claim 24 which further comprises an electrode for trigger discharging.

28. An electric spark-plug for internal combustion engine according to claim 1 wherein at least one of said first and second electrodes has a substantially flat discharging plane and a circumferential portion connected to said flat discharging plane and formed with a convex face connected without ridge line to said discharging plane.

29. An electric spark-plug for internal combustion engine according to claim 28 which further comprises an electrode for trigger discharging.

30. Method of igniting an automobile internal combustion engine of lean gas mixture combustion type using the lean gas mixture having excess air ratio F of $F \geqq 1$ in operation modes including idling, engine-braking, constant speed, acceleration and deceleration, by means of at least one spark-plug comprising:

a metallic screw portion to be engaged with said internal combustion engine, an electrode terminal part, an electric insulator for supporting said screw part and said electrode terminal part in a coaxial relation, keeping them insulated from each other, and at least a pair of electrodes, the pair including a first electrode and a second electrode, said first electrode being supported by a supporter formed on the metallic screw part, said second electrode being rod-shaped and electrically connected to said electrode terminal part by means of a central conductor disposed on the axis of said screw part and in said insulator, said first electrode and said second electrode being supported insulatedly from each other by means of said insulator, keeping a given ignition gap between their discharging faces, the method being characterized in that:

a lean mixture of gas is ignited with a decreasing fluid resistance against gas flow of flame nucleus of said electrodes in a manner to have an ability of ignition that is defined by capability to ignite and burn a lean gas mixture of isobutane and air under conditions of normal temperature (T) of about 20° C, the pressure of lean gas mixture equalling 1 atmospheric pressure (density index $\epsilon$ of about 1), excess air ratio (F) of more than 1.25 and electrode gap distance (Ls) of less than 2mm, so that the following ignition conditional inequality applies thereby to decrease the thermal conductance (G) from the flame nucleus to the electrodes:

$$J > \frac{G}{V}\left\{\frac{\exp(E_b/RT)}{(\alpha-1)B\epsilon^{n+m^*}} \cdot \frac{(n+4.773\,mF)^{n+m^*}}{3.773^{\gamma m} n^n m^{m^*} (X_t - X_i)^{n+m^*} F^{m^*}}\right\} \quad (1),$$

wherein J, $\epsilon$ and $m^*$ is given by $$J = [E_b(T_s - T_o) + RT_s^2]/\pi RT_s^2,$$

$$\epsilon = [(760 - p^-)/760]R_c,$$

$$m^* = (1+\gamma)m,$$

wherein V is the nucleating volume size and is represented by anequation of $V = \theta L_s$ wherein $\theta$ is a proper constant and $L_s$ is the electrode gap distance, T is a temperature of the nucleating volume, $T_o$ is the temperature of the electrodes, $X_i$ is a molar density in 1 atmospheric pressure of incombustible gases other than nitrogen, F, $\epsilon$, $o^-$ and Rc are excess air ratio, density index of molecules, absolute value of negative pressure (mm hg) in intake pipe and compression ratio at the time of ignition, respectively, in the gas mixture, J being practically a constant when the dependences of the singular point temperature $T_s$ upon the variable quantities V, G, $X_1$, F and $\epsilon$ are sufficiently small, $E_b$ is an activation energy in Arrhenius' equation, and is a constant inherent to individual fuel, n and m are the molecularities of reaction of fuel and oxygen, respectively, $\gamma$ is a parameter showing the participation degree of nitrogen molecules in reaction process, $\alpha$ is a multiplication factor of chain carriers, R is a gas constant, B, $X_i$ and $\pi$ are constants, respectively.

31. Method of igniting an internal combustion engine with a spark-plug of claim 30 characterized in that at least a negative electrode has a convex discharging face, said convex discharging face and its circumferential part forming a continuous convex face, and one of said electrodes is made smaller in size measured in the direction having right angle to the discharging direction than the other electrode, said elctrode with smaller size is used as a positive electrode and said other electrode is used as a negative electrode.

32. An automobile internal combustion engine of lean gas mixture combustion type including a combustion chamber, a lean gas mixture producing device for producing lean gas mixture having excess air rato F of $F > 1$ in operation modes including idling, engine-braking, constant speed, acceleration and deceleration, a compressing means which compresses said lean gas mixture containing air and fuel by varying volume of said combustion chamber, at least one electric spark-plug for igniting said compressed lean gas mixture, said spark-plug comprising a metallic screw portion to be engaged with an internal combustion engine, an electrode terminal part, an electric insulator for supporting said screw part and said electrode terminal part in a coaxial relation, keeping them insulated from each other, and at least a pair of electrodes, the pair including a first electrode and a second electrode, said first electrode being supported by a suppoerter formed on the metallic screw part, said second electrode being rod-shaped and electrically connected to said electrode terminal part by means of a central conductor disposed on the axis of said screw part and in said insulator, said first electrode and said second electrode being supported insulatedly from each other by means of said insulator, keeping a given ignition gap between their discharging faces, characterized in that:

fluid resistance against fas flow of flame nucleus of said electrodes is decreased in a manner to have an ability of ignition that is defined by capability to ignite and burn a lean gas mixture of isobutane and air under the conditions of normal temperature (T) of about 20° C, the pressure of lean gas mixture equals 1 atmospheric pressure (density index $\epsilon$ approximately equal to 1), excess air ratio (F) of more than 1.25 and electrode gap distance (Ls) of less than 2mm, so that the following ignition conditional inequality applies thereby to decrease the thermal conductance G from the flame nucleus to the electrodes:

$$J > \frac{G}{V}\left\{\frac{\exp(E_b/RT)}{(\alpha-1)B\epsilon^{n+m^*}} \cdot \frac{(n+4.773\,mF)^{n+m^*}}{3.773^{\gamma m} n^n m^{m^*} (X_t - X_i)^{n+m^*} F^{m^*}}\right\} \quad (1),$$

wherein J, $\epsilon$ and $m^*$ are given by $$J = [Eb\,(T_s - T_o) + RT_s^2]/\pi RT_s^2,$$

$$\epsilon = [760 - p^-)/760]\,R_c,$$

$$m^* = (1 + \gamma)m_{,}.$$

wherein V is the nucleating volume size and is represented by an equation of $V = \theta L_s$ wherein $\theta$ is a proper constant and $L_s$ is the electrode gap distance, T is a temperature of the nucleating volume, $T_o$ is the temperature of the electrodes X; is a molar density in 1 atmospheric pressure of incombustible gases other than nitrogen, F, $\epsilon$, $p^-$ and Rc are excess air ratio, density index of molecules, absolute value of negative pressure (mm Hg) intake pipe and compression ratio at the time of ignition, respectively, in the gas mixture, J being practically a constant when the dependences of the singular point temperature Ts upon the variable quantities V, G, Xi, F and $\epsilon$ are sufficiently small, $E_b$ is an activation energy in Arrhenius' equation, and is a constant inherent to individual fuel, n and m are the molecularities of reaction of fuel and oxygen, respectively, $\gamma$ is a parameter showing the participation degree nitrogen molecules in reaction process, $\alpha$ is a multiplication factor of chain carriers, R is a gas constant, B, $X_t$ and $\pi$ are constants, respectively.

33. An automobile internal combustion engine of lean gas mixture combustion type according to claim 32 wherein in said electric spark-plug the first and second electrodes are rod-shaped electrodes, respectively, the rod-shaped electrode having discharging face at its front end and being 1.7mm or less in diameter where the cross-sectional view of the electrode is circular, and in the longest diagonal line length where the cross-sectional view thereof is a polygonal, and the other rod-shaped electrode having a discharging face at its side face and being 1.2mm or less in width and 2mm or less in thickness.

34. An automobile internal combustion engine of lean gas mixture combustion type according to claim 32 wherein in said electric spark-plug at least one of said first and second electrodes has a convex discharging face with a curvature of at least $0.46mm^{-1}$, said discharging face and its circumferential part forming a continuous convex face.

35. An automobile internal combustion engine of lean gas mixture combustion type according to claim 32 wherein in said electric spark-plug at least one of said electrodes has a recess on or extended part of its discharging face.

36. An automobile internal combustion engine of lean gas mixture combustion type according to claim 32 wherein in said electric spark-plug a surface creeping discharge path between said first and second electrodes is formed on surface of said insulator.

37. An automobile internal combustion engine of lean gas mixture combustion type according to claim 32 wherein in said electric spark-plug at least one of said first and second electrodes has a substantially flat discharging plane and a circumferential portion connected to said flat discharging plane and formed in a convex face connected without ridge line to said discharging plane.

* * * * *